US012618626B2

(12) United States Patent
Brusie et al.

(10) Patent No.: US 12,618,626 B2
(45) Date of Patent: May 5, 2026

(54) CHARGING HANDLE AND UPPER RECEIVER ASSEMBLY FOR A FIREARM

(71) Applicant: Q, LLC, Dover, NH (US)

(72) Inventors: Mitch Brusie, North Branch, MI (US); Ethan Lessard, Dover, NH (US); Nicholas Schafer, Northwood, NH (US)

(73) Assignee: Q, LLC, Dover, NH (US)

( * ) Notice: Subject to any disclaimer, the term of this patent is extended or adjusted under 35 U.S.C. 154(b) by 0 days.

(21) Appl. No.: 18/417,344

(22) Filed: Jan. 19, 2024

(65) Prior Publication Data

US 2025/0237447 A1 Jul. 24, 2025

(51) Int. Cl.
*F41A 3/72* (2006.01)
*F41A 3/66* (2006.01)

(52) U.S. Cl.
CPC . *F41A 3/72* (2013.01); *F41A 3/66* (2013.01)

(58) Field of Classification Search
CPC ..... F41A 3/72
See application file for complete search history.

(56) References Cited

U.S. PATENT DOCUMENTS

2013/0174457 A1* 7/2013 Gangl ..... F41A 3/72 42/16

* cited by examiner

*Primary Examiner* — J. Woodrow Eldred
(74) *Attorney, Agent, or Firm* — EVERSHEDS SUTHERLAND (US) LLP

(57) ABSTRACT

A charging handle assembly for a firearm may include a charging handle body including a handle portion and a shaft portion, a first actuation wing rotatably coupled to the handle portion and configured to rotate about a first rotational axis between a first position and a second position, and a biasing mechanism engaging the first actuation wing and biasing the first actuation wing to the first position. The first actuation wing may include a latch configured to selectively engage an upper receiver assembly of the firearm, and the first actuation wing may have a center of mass disposed along the first rotational axis.

19 Claims, 21 Drawing Sheets

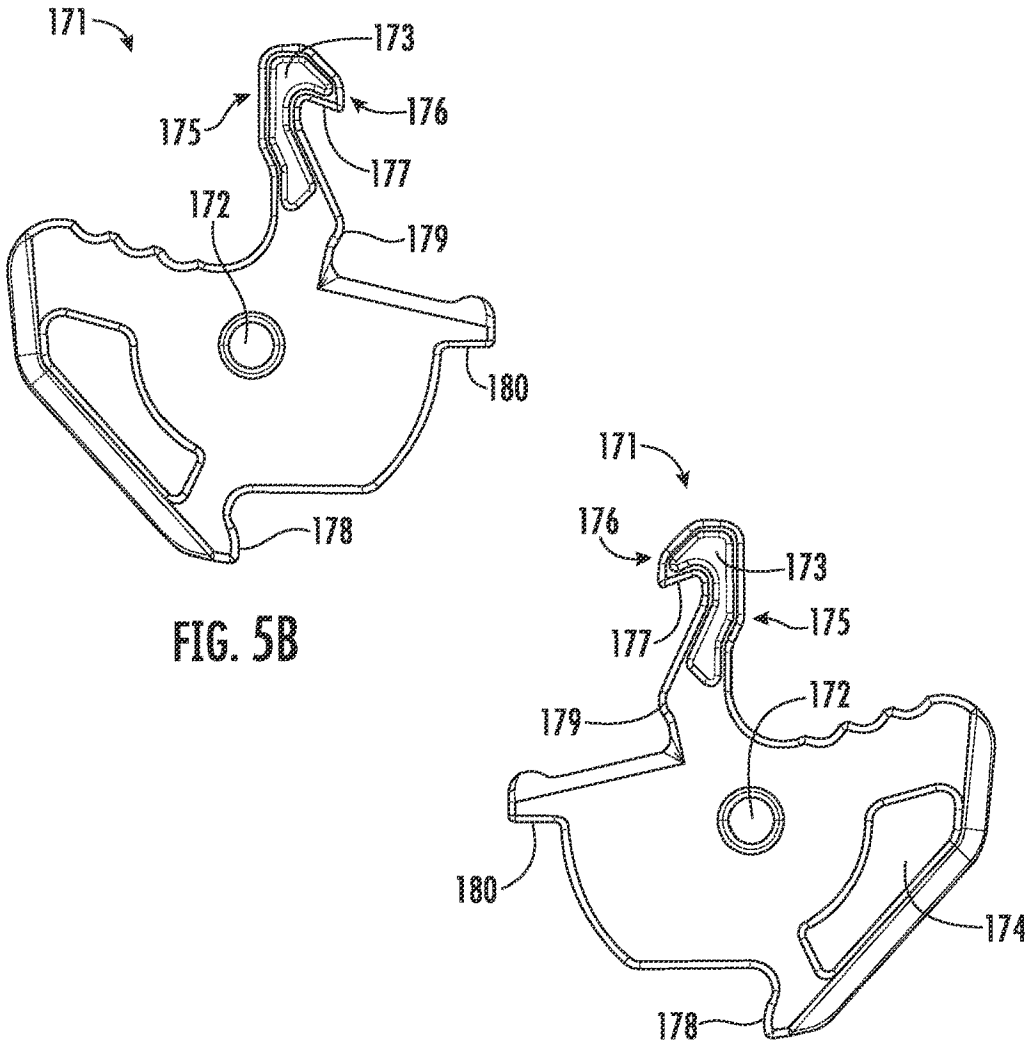
FIG. 5B
FIG. 5C
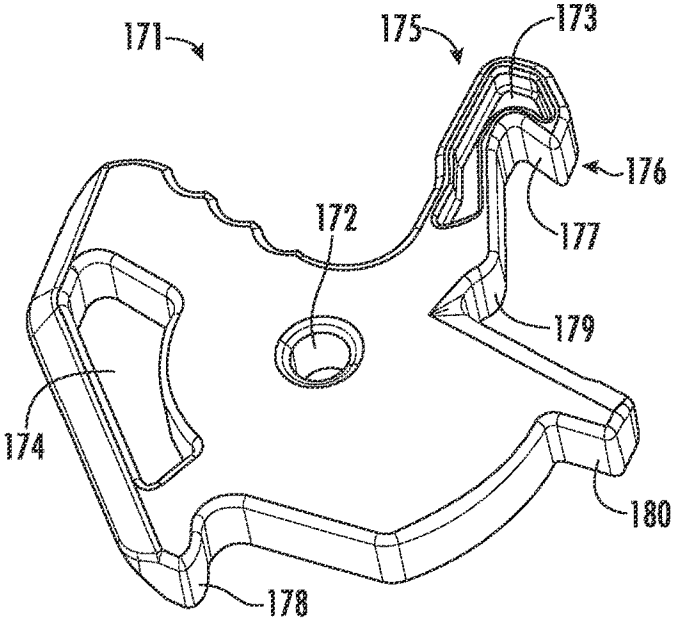
FIG. 5A

CHARGING HANDLE AND UPPER RECEIVER ASSEMBLY FOR A FIREARM

FIELD OF THE DISCLOSURE

The present disclosure relates generally to charging handles for a firearm and, more particularly, to a charging handle and upper receiver assembly of a firearm for inhibiting inadvertent disengagement of the charging handle assembly from an upper receiver and related methods of manufacturing and using the same.

BACKGROUND OF THE DISCLOSURE

Certain semi-automatic or automatic firearms, such as AR-10, AR-15, M16, and M4 type rifles, generally may include a bolt carrier group that moves rearward into a buffer tube and then forward back into an upper receiver during cycling of the action of the firearm. When a cartridge is discharged using the firearm, the rearward movement of the bolt carrier group may cause a casing of the spent cartridge to be removed from the firing chamber and ejected from the firearm, and the forward movement of the bolt carrier group may cause a new cartridge to be pulled from the top of an attached magazine and advanced into the firing chamber for subsequent use. According to various configurations, cycling of the action may be automatic, with the rearward movement of the bolt carrier group being caused by recoil of the firearm and/or high-pressure gas from the discharged cartridge, and with the forward movement of the bolt carrier group being driven by a spring that is compressed during the rearward movement.

In certain instances, an operator of a firearm may desire to manually cycle the action of the firearm. For example, upon loading a new magazine into the firearm, the operator may manually cycle the action to load a new cartridge from the magazine into the firing chamber. Additionally, upon occurrence of a jammed cartridge, the operator may need to manually cycle the action to clear the jam. As other examples, in some instances, the operator may manually cycle the action to clear an undischarged cartridge from the firing chamber or to inspect the action of the firearm.

To facilitate manual cycling of the action, certain firearms, such as AR-10, AR-15, M16, and M4 type rifles, typically may include a charging handle that is configured to be actuated by an operator to cycle the action. The charging handle may be received partially within an upper receiver of the firearm and movable, such as translatable, relative to the upper receiver between a forward position and a rearward position, with the charging handle being spring-biased, via the bolt carrier group, to the forward position. During manual cycling of the action, the charging handle may be pulled rearward from the forward position by an operator to open the action and then released such that the charging handle advances back into the upper receiver to the forward position, via force provided by the compressed spring, to close the action.

Various configurations of charging handles have been developed. Typically, a charging handle may include a main body having a shaft portion and a handle portion disposed at a rearward end of the shaft portion. The shaft portion may include a hook or other feature for engaging and facilitating rearward movement of the bolt carrier group during rearward movement of the charging handle. The handle portion may be configured for being grasped by an operator to facilitate pulling the charging handle rearward. The charging handle also may include a latch member movably coupled, such as rotatably coupled, to the handle portion and configured to move between a first position and a second position, and the latch member may be biased, such as spring-biased, to the first position. The latch member may include a latch, such as a hook-shaped latch, that is configured to selectively engage a recess defined in a lateral wall of the upper receiver when the charging handle is in the forward position and the latch member is in the first position and to disengage the recess when the latch member is moved from the first position to the second position and allow rearward movement of the charging handle. Movement of the latch member from the first position to the second position may be caused by the operator engaging and moving the latch member or another cooperating component of the charging handle, which may occur naturally when the operator grasps the handle portion of the main body for pulling the charging handle rearward. Because the latch engages the recess defined in the lateral wall of the upper receiver, the latch member typically may be positioned along a corresponding lateral side of the charging handle. In some configurations, the charging handle may have an ambidextrous configuration, such that the latch member may be actuated from either of the lateral sides of the charging handle. For example, the charging handle may include a cooperating member positioned along the lateral side of the charging handle opposite the latch member, with the cooperating member being movably coupled, such as rotatably coupled, to the handle portion and configured to move between a first position and a second position, and the cooperating member may be biased, such as spring-biased, to the first position. The cooperating member may be configured such that when the cooperating member is engaged and moved from its first position to its second position, the cooperating member engages and causes the latch member to move from its first position to its second position, thereby causing the latch to disengage the recess and allow rearward movement of the charging handle. In this manner, the operator may actuate the charging handle by engaging and moving either the latch member or the cooperating member to disengage the latch from the recess.

Although existing charging handles may be suitable for some firearm applications, they may present certain drawbacks in other firearm applications. A particular concern relates to inadvertent disengagement of the latch of the charging handle from the recess of the upper receiver during operation of the firearm. Notably, as firearms become lighter, the amount of momentum, recoil, vibration, and other forces acting on the firearm and components thereof resulting from discharge of a cartridge may increase significantly. Such increased forces may be more pronounced when larger caliber rounds are used with light-weight firearms. Additionally, the barrels of modern firearms may be configured to provide the expelled projectile with a significantly greater twist rate, as compared to the twist rates provided by the barrels of conventional firearms. For example, the barrels of certain modern firearms may provide a twist rate of 1:3, as compared to a more conventional twist rate of 1:10. With a greater twist rate, a greater amount of energy is produced by the spinning projectile, which causes the firearm to spin in the opposite direction. Increased forces acting on the firearm and components thereof, whether resulting from lighter-weight firearms, larger caliber rounds, and/or greater twist rates, may increase the likelihood of the latch of the charging handle inadvertently becoming disengaged from the recess of the upper receiver during operation of the firearm.

A need therefore remains for improved charging handle and upper receiver assemblies of a firearm for inhibiting inadvertent disengagement of the charging handle assembly from an upper receiver and related methods of manufacturing and using the same, which may address one or more of the above-mentioned concerns associated with existing charging handles.

SUMMARY OF THE DISCLOSURE

The present disclosure provides charging handle assemblies for a firearm, upper receiver assemblies for a firearm, upper assemblies for a firearm, and related methods of manufacturing and using such assemblies.

In one aspect, a charging handle assembly for a firearm is provided. According to one example, the charging handle assembly may include a charging handle body including a handle portion and a shaft portion, a first actuation wing rotatably coupled to the handle portion and configured to rotate about a first rotational axis between a first position and a second position, and a biasing mechanism engaging the first actuation wing and biasing the first actuation wing to the first position. The first actuation wing may include a latch configured to selectively engage an upper receiver assembly of the firearm, and the first actuation wing may have a center of mass disposed along the first rotational axis.

In some examples, the charging handle assembly also may include a second actuation wing rotatably coupled to the handle portion and configured to rotate about a second rotational axis between a third position and a fourth position, with the second rotational axis extending parallel to the first rotational axis. The second actuation wing may have a center of mass disposed along the second rotational axis, and the biasing mechanism may engage the second actuation wing and bias the second actuation wing to the third position. In some examples, the first actuation wing may include a first cooperating engagement portion, the second actuation wing may include a second cooperating engagement portion, and rotation of the second actuation wing from the third position to the fourth position may cause the second cooperating engagement portion to engage the first cooperating engagement portion and rotate the first actuation wing from the first position to the second position. In some examples, the biasing mechanism may include a first plunger engaging the first actuation wing, a second plunger engaging the second actuation wing, a first spring engaging the first plunger and biasing the first plunger toward the first actuation wing, and a second spring engaging the second plunger and biasing the second plunger toward the second actuation wing, with the first plunger, the second plunger, the first spring, and the second spring extending in a direction perpendicular to a longitudinal axis of the charging handle body.

In some examples, the latch may include a latch engagement surface configured to engage the upper receiver assembly, the latch engagement surface may define a negative angle relative to a direction perpendicular to a longitudinal axis of the charging handle body, and the negative angle may be within a range of 1 degree to 30 degrees. In some examples, the charging handle assembly also may include a bumper coupled to the handle portion and configured to bias the handle portion rearward relative to the upper receiver assembly when the latch engages the upper receiver assembly. In some examples, the bumper may be formed of a resiliently compressible material and configured to be resiliently compressed between the handle portion and the upper receiver assembly when the latch engages the upper receiver assembly.

In another aspect, an upper receiver assembly for a firearm is provided. According to one example, the upper receiver assembly may include an upper receiver body including a recess defined in a lateral surface of the upper receiver body, and a latch plate disposed at least partially within the recess. The latch plate may include an opening configured to selectively receive a portion of a latch of a charging handle assembly, and a latch-plate engagement surface defining a portion of the opening. The latch-plate engagement surface may be configured to engage a latch engagement surface of the latch when the portion of the latch is received within the opening.

In some examples, the recess may extend from a top surface of the upper receiver body, and the latch plate may be coupled to the upper receiver body via a dovetail connection. In some examples, the upper receiver body may be formed of a first material having a first hardness, and the latch plate may be formed of a second material having a second hardness that is greater than the first hardness. In some examples, the latch plate also may include a plate portion including a surface extending flush with the lateral surface of the upper receiver body, an extension portion extending from the plate portion and laterally beyond the lateral surface of the upper receiver body, with the extension portion at least partially surrounding the opening, and a ramp leading to the opening and configured to deflect the latch as the latch engages the latch plate and moves toward the opening.

In some examples, the upper receiver assembly also may include a bumper coupled to the upper receiver body and configured to bias the charging handle assembly rearward relative to the upper receiver body such that the latch-plate engagement surface engages the latch engagement surface when the portion of the latch is received within the opening. In some examples, the bumper may be formed of a resiliently compressible material and configured to be resiliently compressed between the upper receiver body and the charging handle assembly when the portion of the latch is received within the opening. In some examples, the upper receiver assembly also may include a top rail removably coupled to the upper receiver body and at least partially covering a top end of the recess when the top rail is coupled to the upper receiver body.

In another aspect, an upper receiver assembly for a firearm is provided. According to one example, the upper receiver assembly may include an upper receiver body, an opening configured to selectively receive a portion of a latch of a charging handle assembly, and a bumper coupled to the upper receiver body and configured to bias the charging handle assembly rearward relative to the upper receiver body when the portion of the latch is received within the opening.

In some examples, the bumper may be formed of a resiliently compressible material and configured to be resiliently compressed between the upper receiver body and the charging handle assembly when the portion of the latch is received within the opening. In some examples, the bumper may be further configured to bias the charging handle assembly downward relative to the upper receiver body when the portion of the latch is received within the opening. In some examples, the upper receiver body may include a cutout defined in a top surface of the upper receiver body, and the bumper may be disposed at least partially within the cutout. In some examples, the upper receiver assembly also may include a top rail removably coupled to the upper receiver body and covering at least a portion of the bumper when the top rail is coupled to the upper receiver body. In some examples, the upper receiver assembly also may include a latch plate coupled to the upper receiver body and defining the opening, and the latch plate may include a latch-plate engagement surface defining a portion of the opening and configured to engage a latch engagement surface of the latch when the portion of the latch is received within the opening.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

FIG. 5A is a detailed perspective view of the first actuation wing of the charging handle body of the charging handle assembly of the upper assembly of FIG. 1A.

FIG. 5B is a top view of the first actuation wing of FIG. 5A.

FIG. 5C is a bottom view of the first actuation wing of FIG. 5A.

DETAILED DESCRIPTION OF THE DISCLOSURE

Figure 1A:
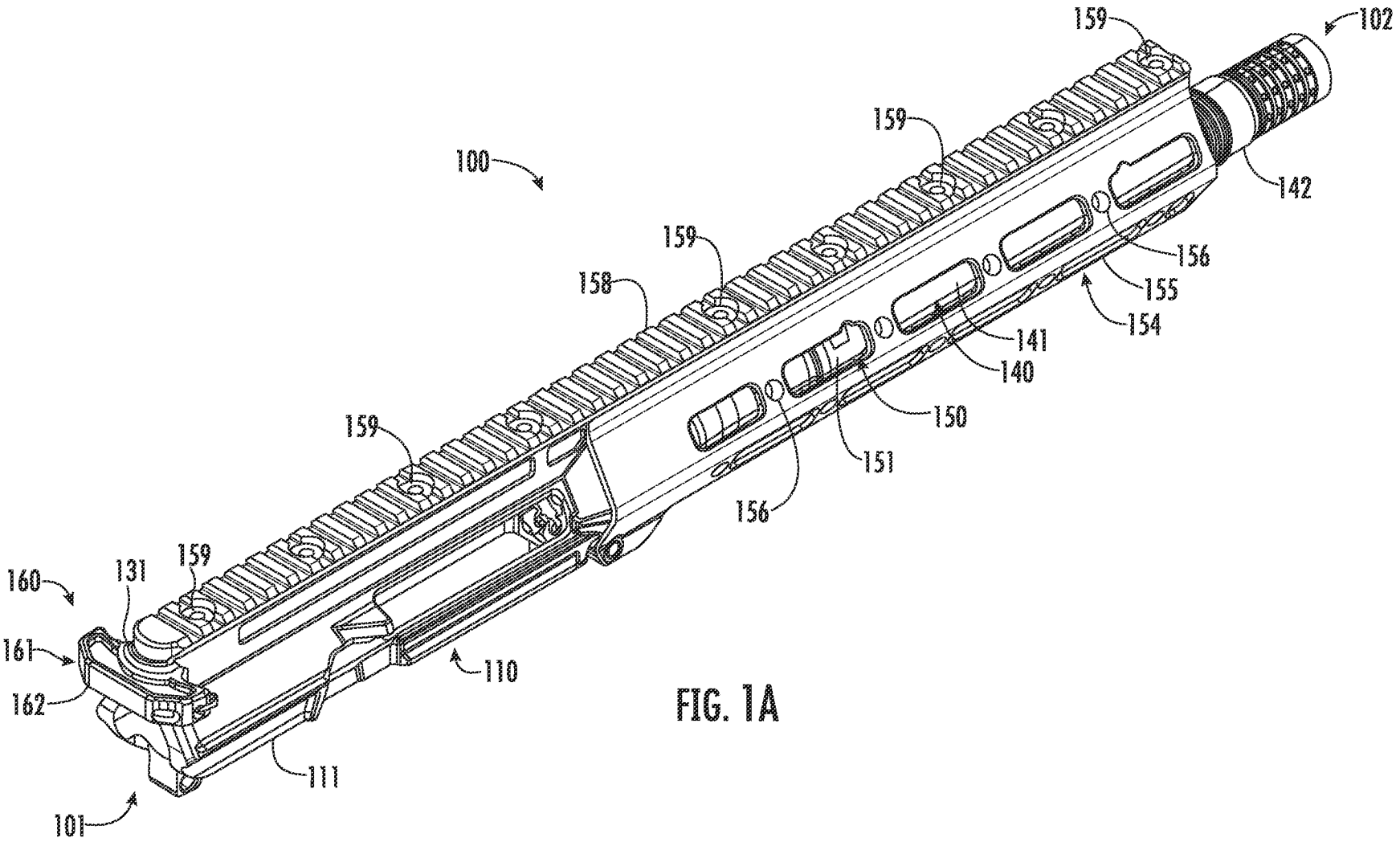
FIG. 1A is a perspective view of an upper assembly for a firearm according to one or more examples of the disclosure, with the upper assembly including an upper receiver assembly, a barrel assembly, a gas block assembly, a handguard assembly, a top rail, and a charging handle assembly, and showing the charging handle assembly in a forward position.
Figure 1B:
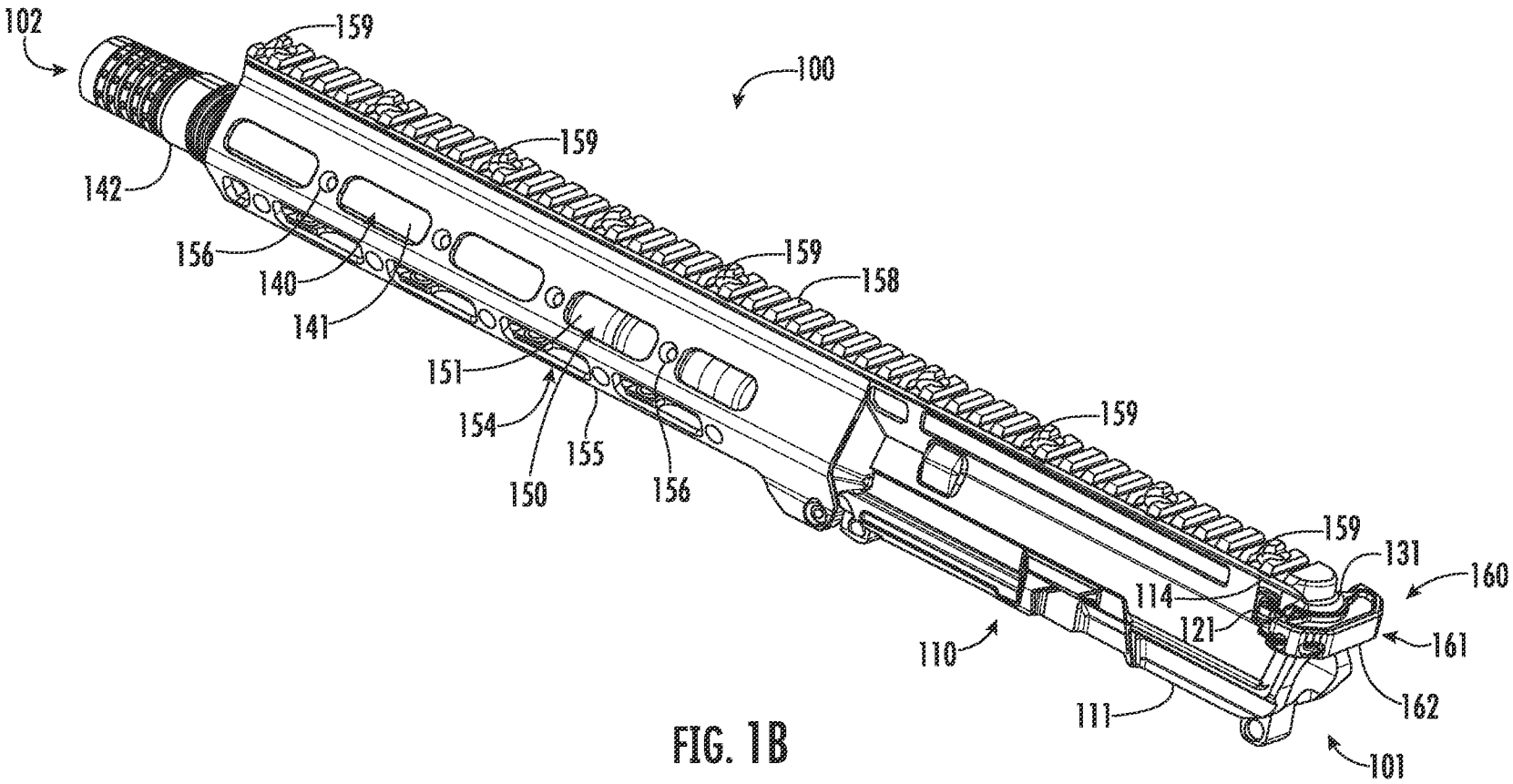
FIG. 1B is another perspective view of the upper assembly of FIG. 1A, showing the charging handle assembly in the forward position.
Figure 1C:
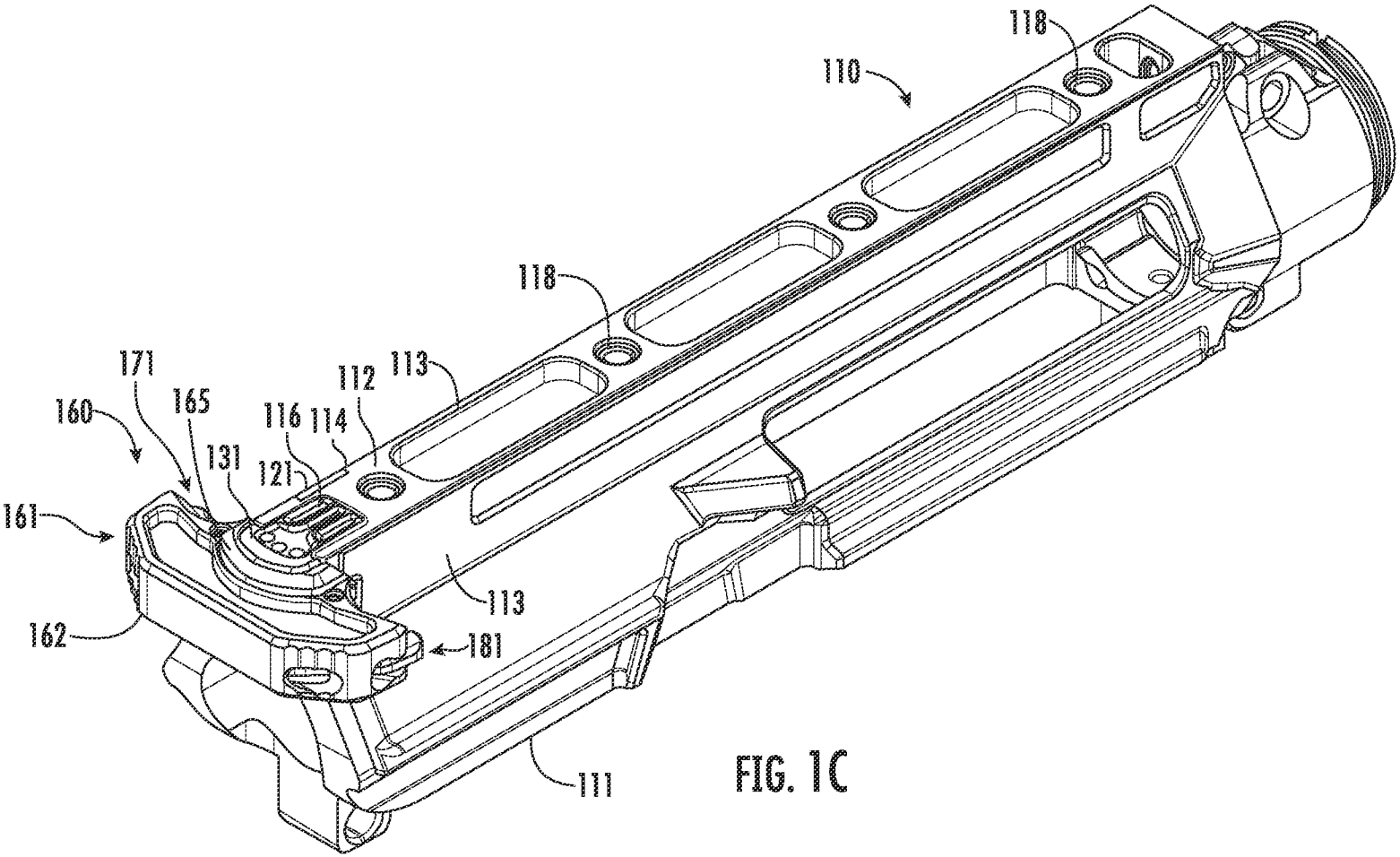
FIG. 1C is a perspective view of the upper receiver assembly and the charging handle assembly of the upper assembly of FIG. 1A, showing the charging handle assembly in the forward position.
Figure 1D:
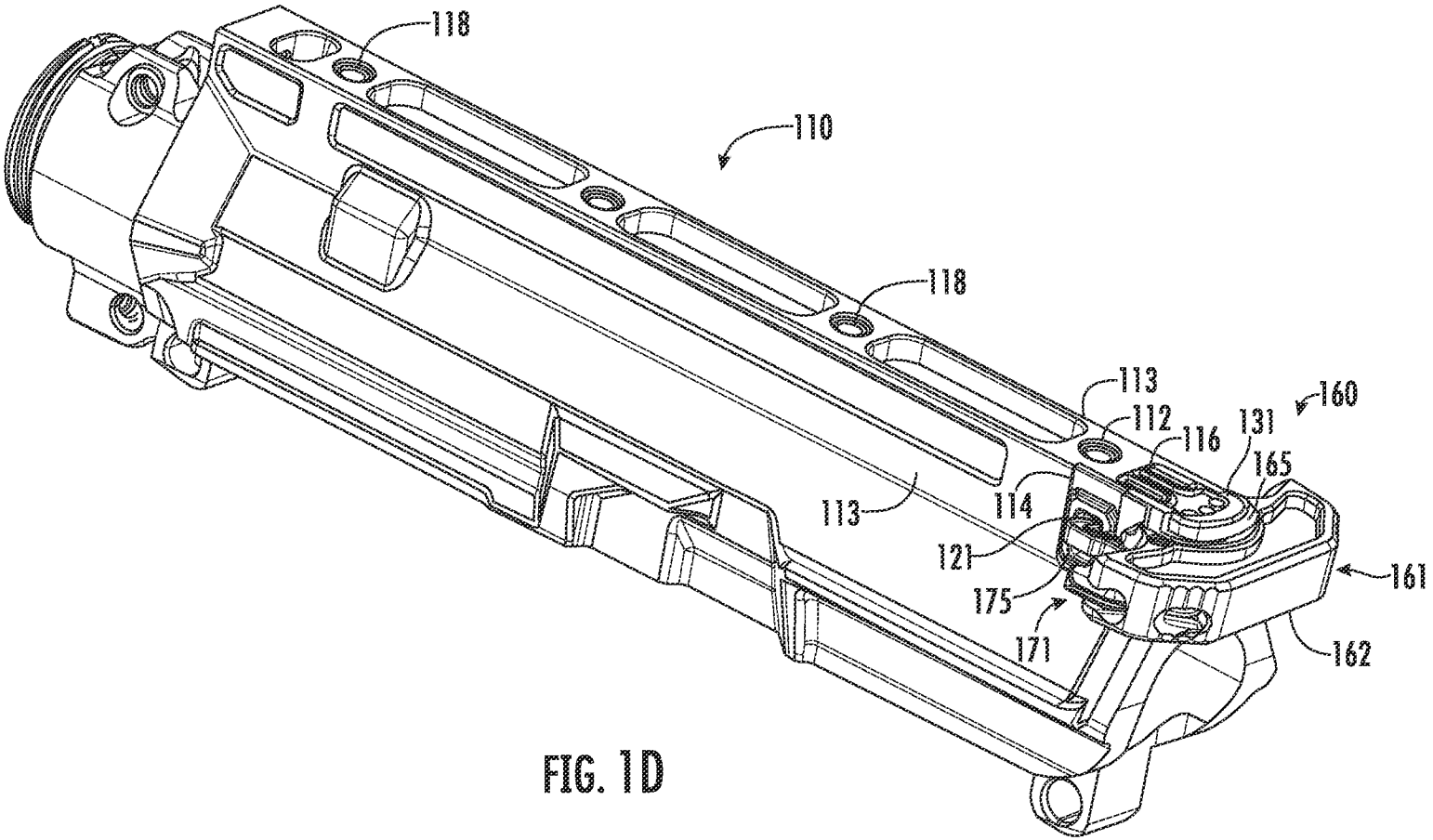
FIG. 1D is another perspective view of the upper receiver assembly and the charging handle assembly of the upper assembly of FIG. 1A, showing the charging handle assembly in the forward position.
Figure 1E:
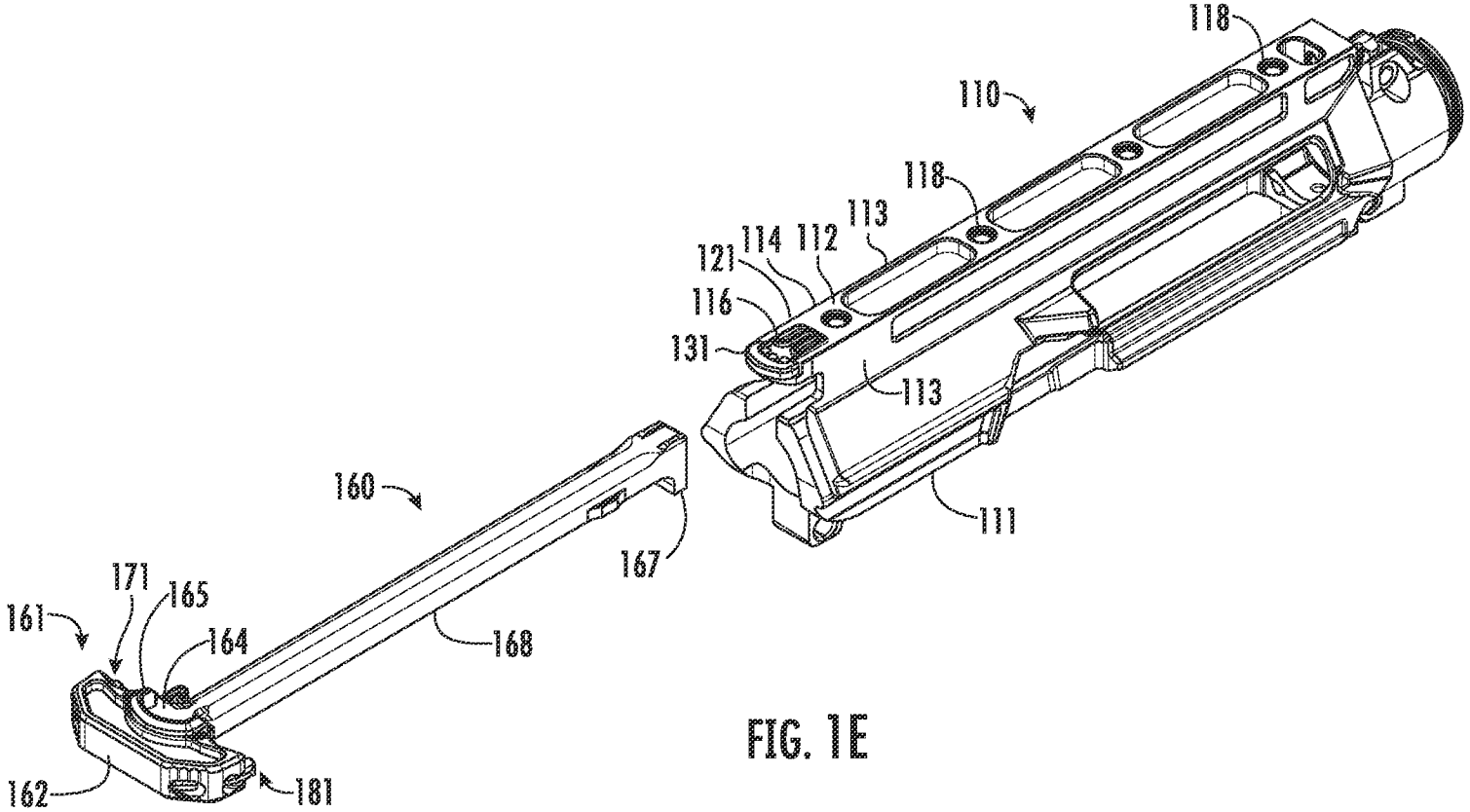
FIG. 1E is a partially-exploded perspective view of the upper receiver assembly and the charging handle assembly of the upper assembly of FIG. 1A, showing the charging handle assembly removed from the upper receiver assembly.
Figure 1F:
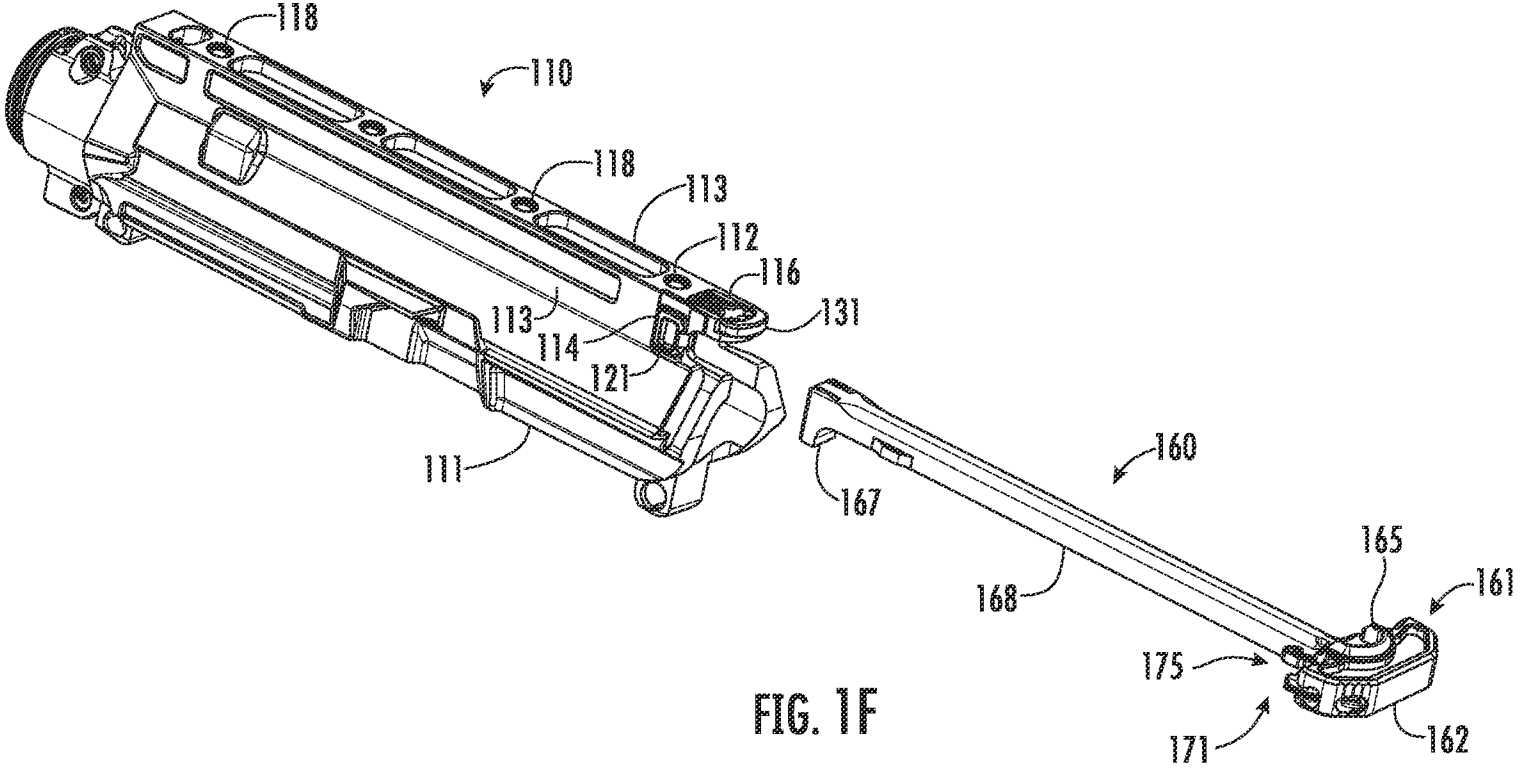
FIG. 1F is another perspective view of the upper receiver assembly and the charging handle assembly of the upper assembly of FIG. 1A, showing the charging handle assembly removed from the upper receiver assembly.
Figure 1G:
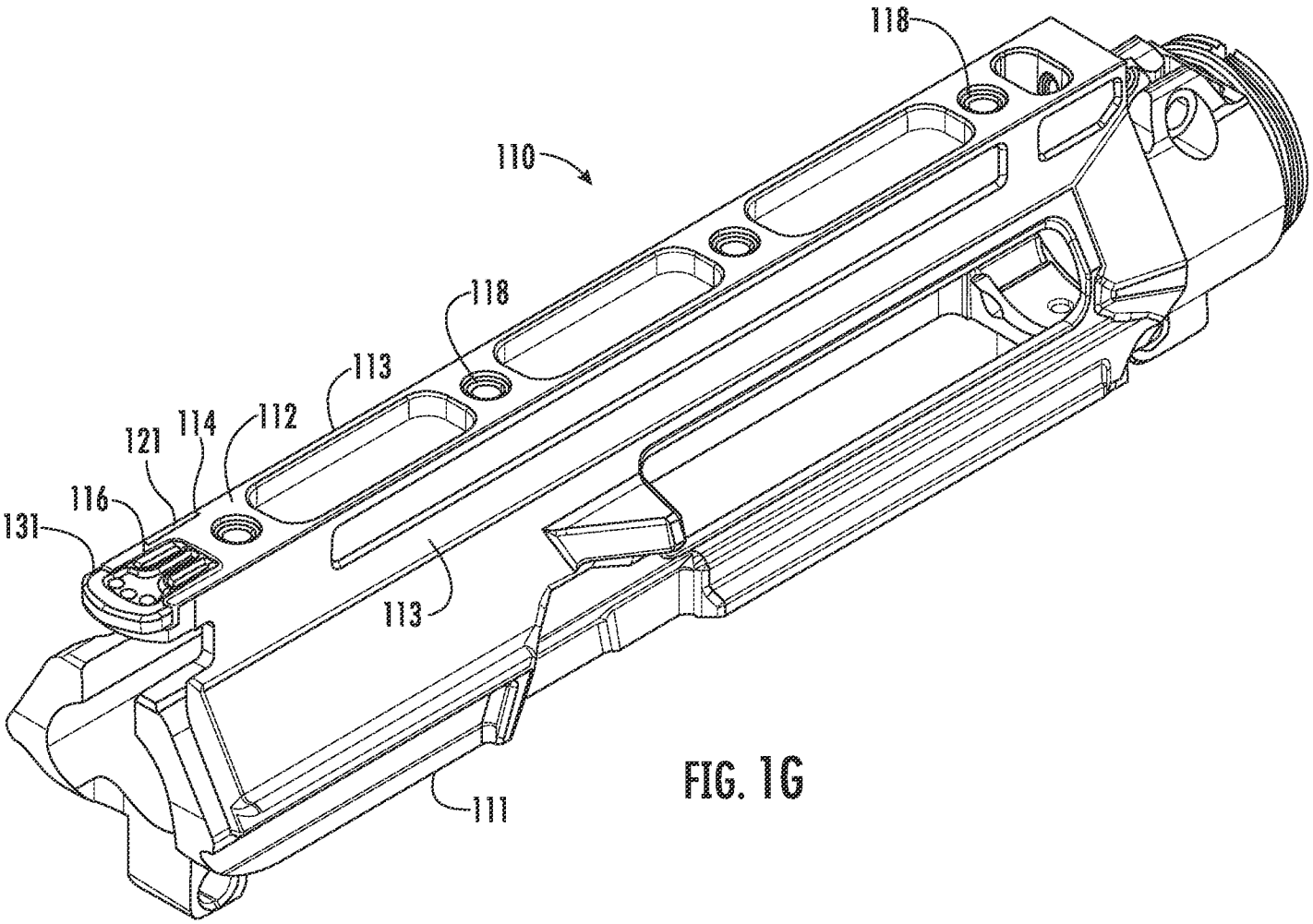
FIG. 1G is a perspective view of the upper receiver assembly of the upper assembly of FIG. 1A, showing an upper receiver body, a latch plate, and a bumper of the upper receiver assembly.
Figure 1H:
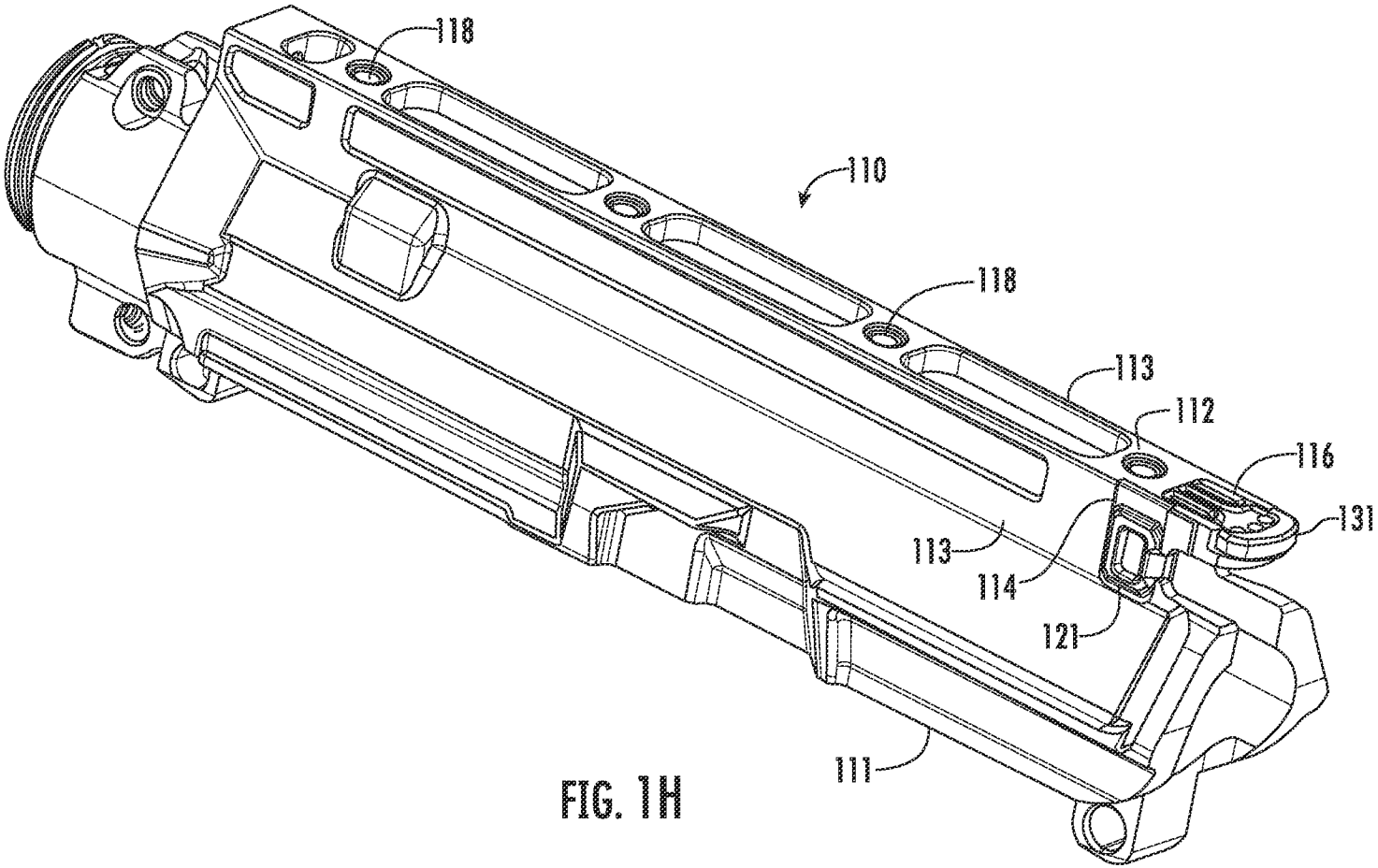
FIG. 1H is another perspective view of the upper receiver assembly of the upper assembly of FIG. 1A, showing the upper receiver body, the latch plate, and the bumper.

In the following description, specific details are set forth describing some examples consistent with the present disclosure. Numerous specific details are set forth in order to provide a thorough understanding of the examples. It will be apparent, however, to one skilled in the art that some examples may be practiced without some or all of these specific details. The specific examples disclosed herein are meant to be illustrative but not limiting. One skilled in the art may realize other examples that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. In some instances, well known methods, procedures, and components have not been described in detail so as not to unnecessarily obscure aspects of the examples.

The present disclosure provides charging handle assemblies for a firearm, upper receiver assemblies for a firearm, upper assemblies for a firearm, and related methods of manufacturing and using such assemblies. In some examples, the charging handle assemblies, upper receiver assemblies, and upper assemblies may be designed for use with particular semi-automatic or fully-automatic firearms, such as AR-10, AR-15, M16, and M4 type rifles. To facilitate manual cycling of the action, a firearm may include a charging handle assembly that is configured to be actuated by an operator to cycle the action. The charging handle assembly may be received partially within an upper receiver of the firearm and movable, such as translatable, relative to the upper receiver between a forward position and a rearward position, with the charging handle assembly being spring-biased, via a bolt carrier group, to the forward position. During manual cycling of the action, the charging handle may be pulled rearward from the forward position by an operator to open the action and then released such that the charging handle advances back into the upper receiver to the forward position, via force provided by the compressed spring, to close the action.

As described above, a conventional charging handle may include a main body having a shaft portion and a handle portion disposed at a rearward end of the shaft portion. The shaft portion may include a hook or other feature for engaging and facilitating rearward movement of the bolt carrier group during rearward movement of the charging handle. The handle portion may be configured for being grasped by an operator to facilitate pulling the charging handle rearward. The charging handle also may include a latch member movably coupled, such as rotatably coupled, to the handle portion and configured to move between a first position and a second position, and the latch member may be biased, such as spring-biased, to the first position. The latch member may include a latch, such as a hook-shaped latch, that is configured to selectively engage a recess defined in a lateral wall of the upper receiver when the charging handle is in the forward position and the latch member is in the first position and to disengage the recess when the latch member is moved from the first position to the second position and allow rearward movement of the charging handle. Movement of the latch member from the first position to the second position may be caused by the operator engaging and moving the latch member or another cooperating component of the charging handle, which may occur naturally when the operator grasps the handle portion of the main body for pulling the charging handle rearward. Because the latch engages the recess defined in the lateral wall of the upper receiver, the latch member typically may be positioned along a corresponding lateral side of the charging handle. In some configurations, the charging handle may have an ambidextrous configuration, such that the latch member may be actuated from either of the lateral sides of the charging handle. For example, the charging handle may include a cooperating member positioned along the lateral side of the charging handle opposite the latch member, with the cooperating member being movably coupled, such as rotatably coupled, to the handle portion and configured to move between a first position and a second position, and the cooperating member may be biased, such as spring-biased, to the first position. The cooperating member may be configured such that when the cooperating member is engaged and moved from its first position to its second position, the cooperating member engages and causes the latch member to move from its first position to its second position, thereby causing the latch to disengage the recess and allow rearward movement of the charging handle. In this manner, the operator may actuate the charging handle by engaging and moving either the latch member or the cooperating member to disengage the latch from the recess.

As discussed above, existing charging handles may present certain drawbacks in some firearm applications. A particular concern relates to inadvertent disengagement of the latch of the charging handle from the recess of the upper receiver during operation of the firearm. As firearms become lighter, the amount of momentum, recoil, vibration, and other forces acting on the firearm and components thereof resulting from discharge of a cartridge may increase significantly. Such increased forces may be more pronounced when larger caliber rounds are used with light-weight firearms. Additionally, the barrels of modern firearms may be configured to provide the expelled projectile with a significantly greater twist rate, as compared to the twist rates provided by the barrels of conventional firearms. For example, the barrels of certain modern firearms may provide a twist rate of 1:3, as compared to a more conventional twist rate of 1:10. With a greater twist rate, a greater amount of energy is produced by the spinning projectile, which causes the firearm to spin in the opposite direction. Increased forces acting on the firearm and components thereof, whether resulting from lighter-weight firearms, larger caliber rounds, and/or greater twist rates, may increase the likelihood of the latch of the charging handle inadvertently becoming disengaged from the recess of the upper receiver during operation of the firearm.

According to examples described herein, charging handle assemblies for a firearm, upper receiver assemblies for a firearm, and upper assemblies for a firearm may be configured in a manner that inhibits inadvertent disengagement of a charging handle assembly from an upper receiver assembly, thereby minimizing the above-noted concerns associated with existing charging handles.

As described herein, a charging handle assembly may include a charging handle body including a handle portion and a shaft portion, a first actuation wing rotatably coupled to the handle portion and configured to rotate about a first rotational axis, a second actuation wing rotatably coupled to the handle portion and configured to rotate about a second rotational axis extending parallel to the first rotational axis, a first plunger engaging the first actuation wing, a second plunger engaging the second actuation wing, and a spring engaging each of the first plunger and the second plunger. The first actuation wing may include a latch configured to selectively engage an upper receiver assembly of the firearm, and the first actuation wing may have a center of mass disposed along the first rotational axis. Notably, by positioning the center of mass of the first actuation wing along the first rotational axis, the first actuation wing may be balanced. In this manner, inadvertent disengagement of the latch from the upper receiver assembly may be avoided because the first actuation wing may remain stationary, or substantially stationary, relative to the upper receiver assembly even when the firearm recoils, vibrates, or otherwise moves during discharge of a cartridge.

As described herein, an upper receiver assembly may include an upper receiver body including a recess defined in a lateral surface of the upper receiver body, and a latch plate disposed at least partially within the recess. The latch plate may include an opening configured to selectively receive a portion of a latch of a charging handle assembly, and a latch-plate engagement surface defining a portion of the opening. The latch-plate engagement surface may be configured to engage a latch engagement surface of the latch when the portion of the latch is received within the opening. Notably, by providing the latch plate as a separate component from the upper receiver body, desired geometry of the opening and the latch-plate engagement surface may be more economically machined as compared to manufacturing such features in the upper receiver body itself. Moreover, the disclosed configuration allows the latch plate and the upper receiver body to be formed of different materials, which may provide a more robust design that minimizes wear of the engagement surfaces of the latch plate and the latch. For example, the latch plate may be formed of a material having a greater hardness than the material of the upper receiver body. Consequently, after continued use of the firearm, inadvertent disengagement of the latch from the upper receiver assembly due, at least in part, to wear may be avoided.

As described herein, in some examples, the upper receiver assembly may include a bumper formed of a resiliently compressible material and coupled to the upper receiver body, with the bumper being configured to be resiliently compressed between the upper receiver body and the charging handle assembly when the charging handle assembly is in the forward position and the latch is received within the opening of the latch plate. In other examples, the charging handle assembly may include a bumper formed of a resiliently compressible material and coupled to the charging handle body, with the bumper being configured to be resiliently compressed between the charging handle body and the upper receiver assembly when the charging handle assembly is in the forward position and the latch is received within the opening of the latch plate. According to either approach, the bumper may provide an axial force to drive the latch engagement surface of the latch into engagement with the latch-plate engagement surface of the latch plate, thereby inhibiting inadvertent disengagement of the latch from the opening.

Still other benefits and advantages of the disclosed charging handle assemblies for a firearm, upper receiver assemblies for a firearm, upper assemblies for a firearm, and related methods over conventional devices and techniques will be appreciated by those of ordinary skill in the art from the present disclosure.

Example Upper Assemblies, Upper Receiver Assemblies, and Charging Handle Assemblies Referring now to the drawings, FIGS. 1A-1K depict an upper assembly 100 (which also may be referred to as a "firearm upper assembly" or simply an "assembly") for a firearm and components of the upper assembly 100 according to one or more examples of the present disclosure. FIGS. 2A-6C illustrate example components of the upper assembly 100, while FIGS. 7A-7D illustrate example actuation of portions of the upper assembly 100. The upper assembly 100 may be provided as an elongated structure having a rearward end (which also may be referred to as a "proximal end" or a "first end") 101 and a forward end (which also may be referred to as a "proximal end" or a "first end") 102 disposed opposite one another along a longitudinal axis of the upper assembly 100. As shown, the upper assembly 100 may include an upper receiver assembly (which also may be referred to as an "upper receiver") 110, a barrel assembly (which also may be referred to as a "barrel") 140, a gas block assembly 150, a handguard assembly (which also may be referred to as a "handguard") 154, a top rail 158, and a charging handle assembly (which also may be referred to as a "charging handle") 160 each having a rearward end and a forward end corresponding to the rearward end 101 and the forward end 102, respectively, of the upper assembly 100. The illustrated components and features thereof are merely examples, as various configurations of the upper receiver assembly 110, the barrel assembly 140, the gas block assembly 150, the handguard assembly 154, the top rail 158, and the charging handle assembly 160 may be used in different examples of the present disclosure. In some examples, the upper assembly 100 also may include additional components and/or features. It will be appreciated that the upper assembly 100 may be used in combination with various other firearm components, which may be conventional or of custom configuration, to form a complete firearm.

Figure 1J:
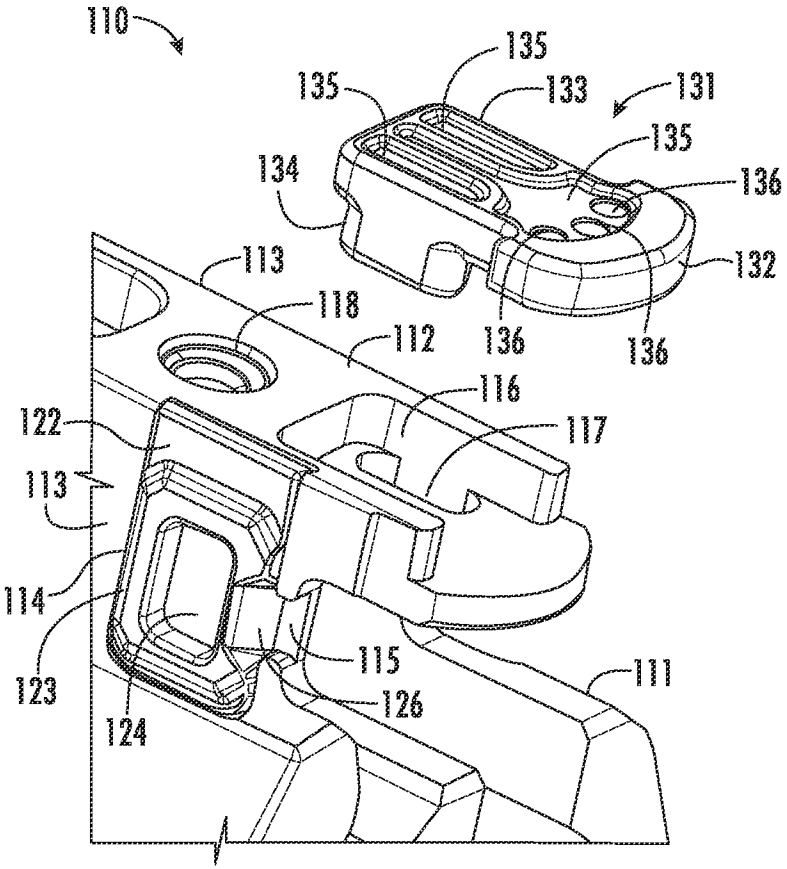
FIG. 1J is a detailed, partially-exploded perspective view of a portion of the upper receiver assembly of the upper assembly of FIG. 1A, showing the bumper removed from the upper receiver body.
Figure 1I:
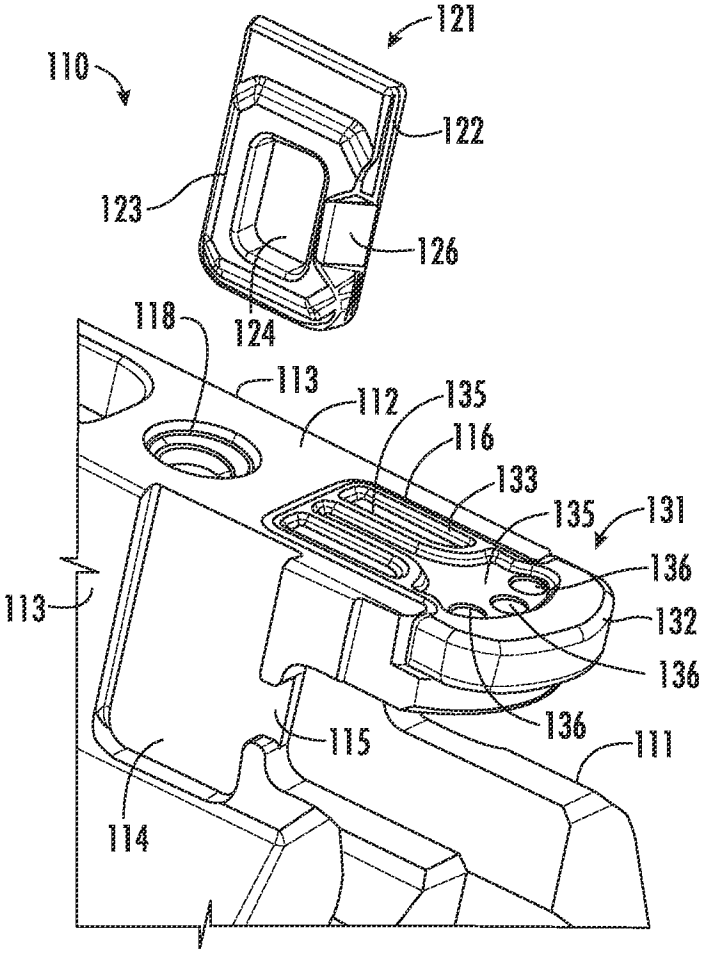
FIG. 1I is a detailed, partially-exploded perspective view of a portion of the upper receiver assembly of the upper assembly of FIG. 1A, showing the latch plate removed from the upper receiver body.
Figure 1K:
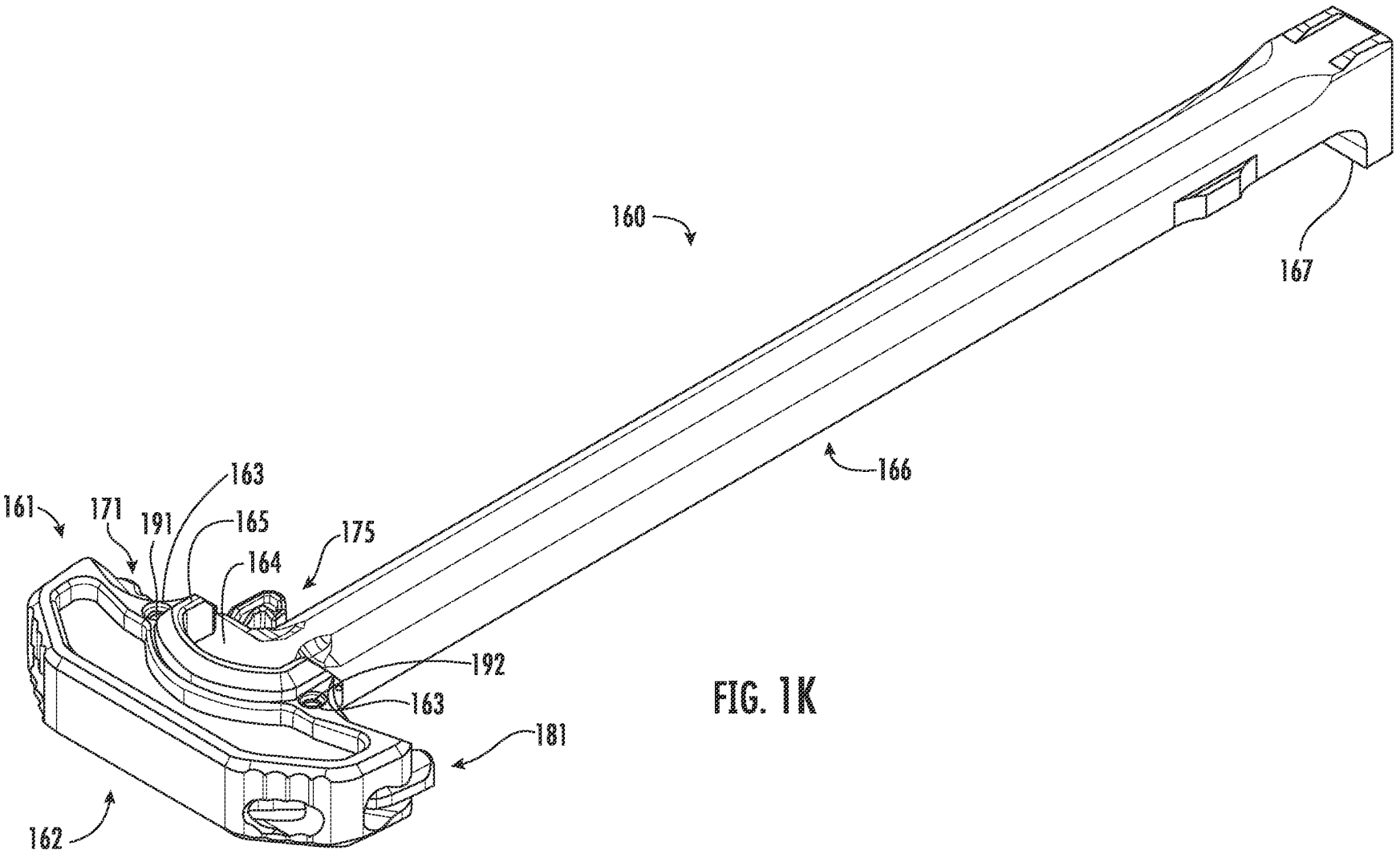
FIG. 1K is a perspective view of the charging handle assembly of the upper assembly of FIG. 1A, showing a charging handle body, a first actuation wing, a second actuation wing and a pair of pins of the charging handle assembly.
Figure 1L:
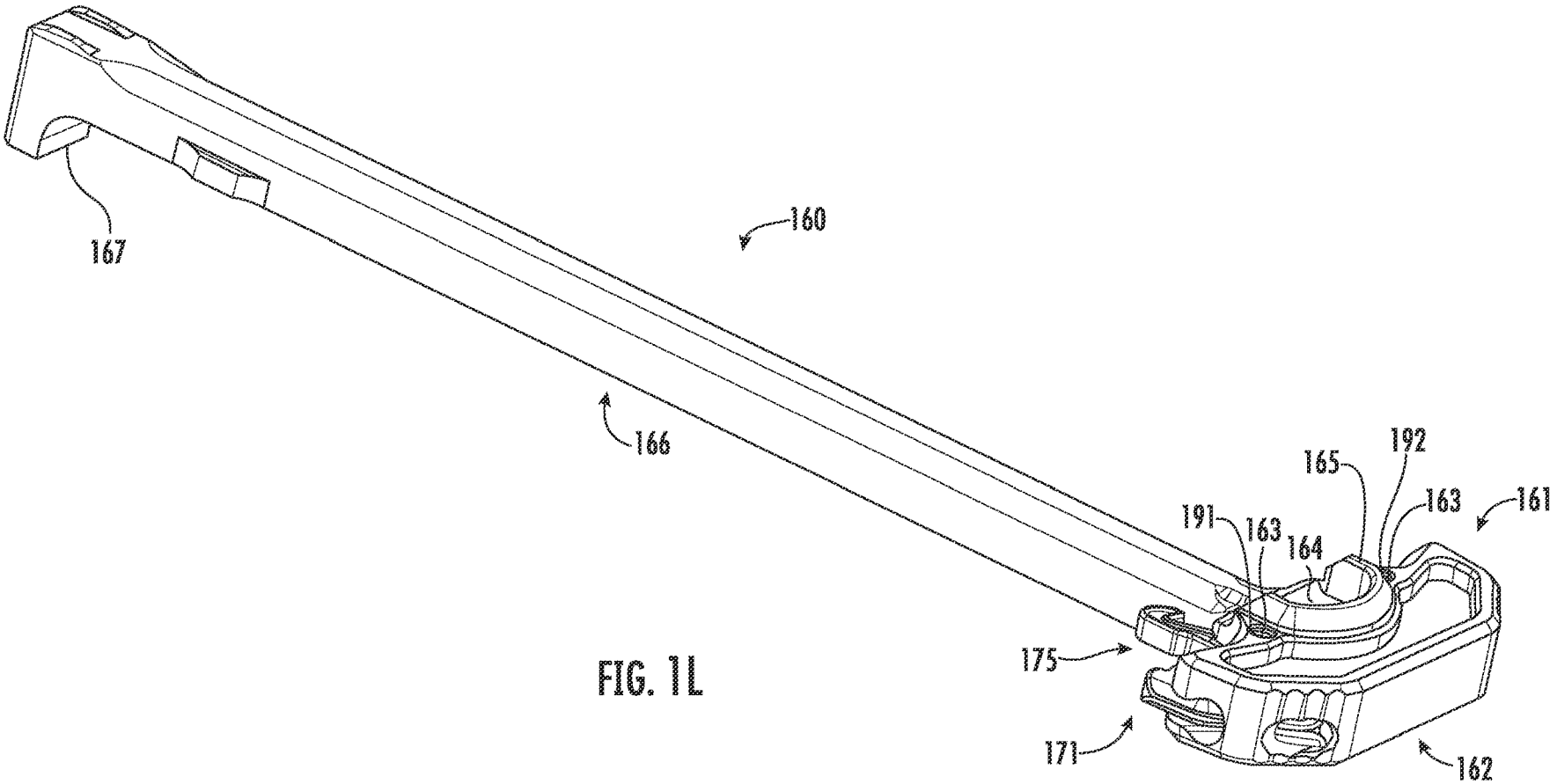
FIG. 1L is another perspective view of the charging handle assembly of the upper assembly of FIG. 1A, showing the charging handle body, the first actuation wing, the second actuation wing and the pins of the charging handle assembly.
Figure 1M:
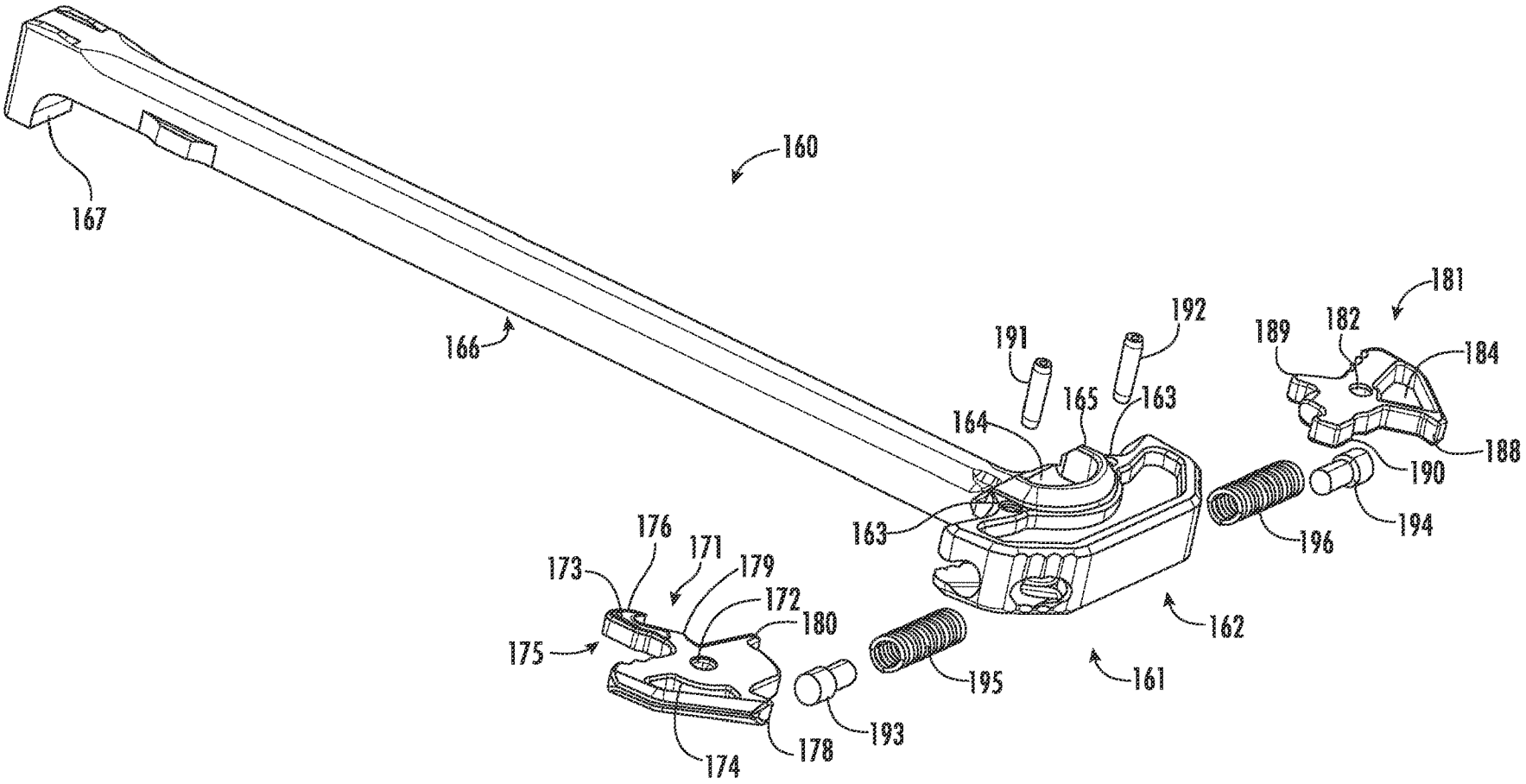
FIG. 1M is an exploded perspective view of the charging handle assembly of the upper assembly of FIG. 1A, showing the charging handle body, the first actuation wing, the second actuation wing, the pins, a pair of plungers, and a pair of springs of the charging handle assembly.
Figure 2B:
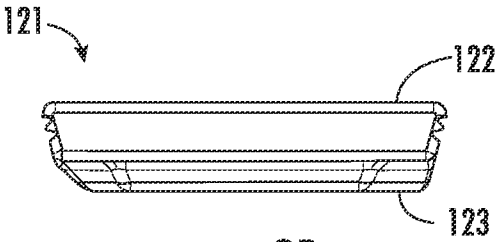
FIG. 2B is a top view of the latch plate of FIG. 2A.
Figure 2C:
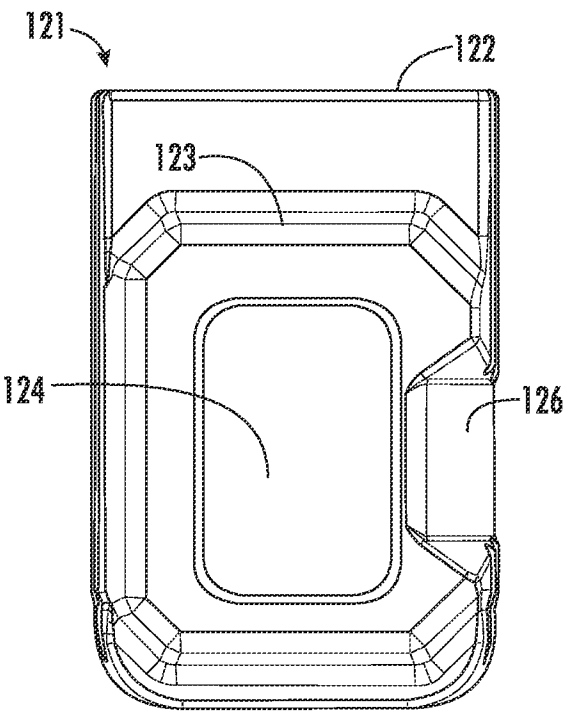
FIG. 2C is a front view of the latch plate of FIG. 2A.
Figure 2D:
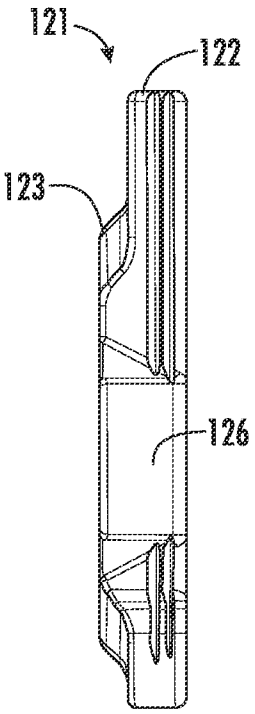
FIG. 2D is a side view of the latch plate of FIG. 2A.
Figure 2A:
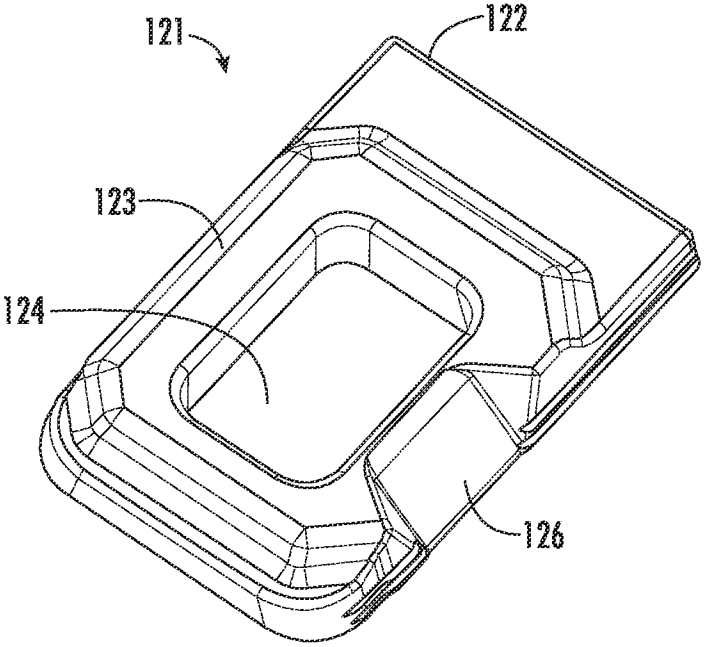
FIG. 2A is a detailed perspective view of the latch plate of the upper receiver assembly of the upper assembly of FIG. 1A.
Figure 3B:
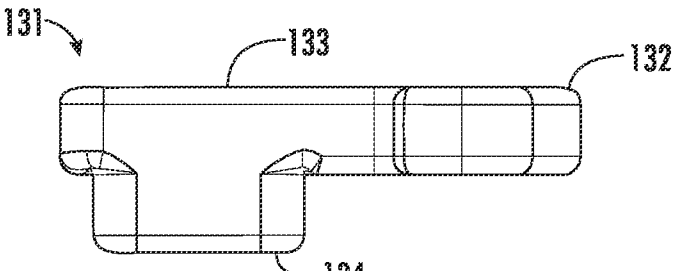
FIG. 3B is a top view of the bumper of FIG. 3A.
Figure 3D:
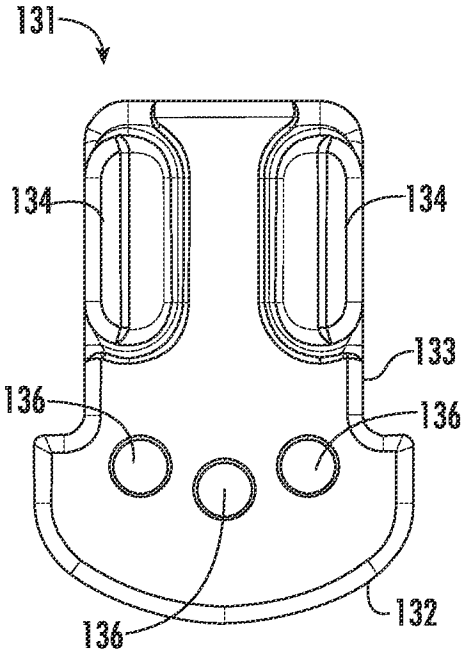
FIG. 3D is a side view of the bumper of FIG. 3A.
Figure 3C:
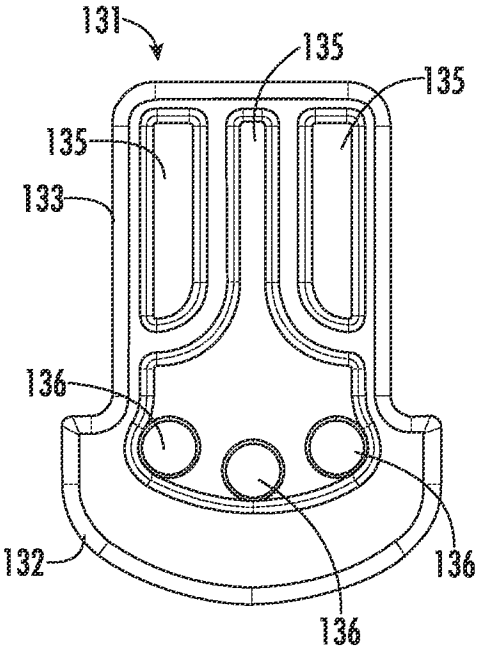
FIG. 3C is a front view of the bumper of FIG. 3A.
Figure 3A:
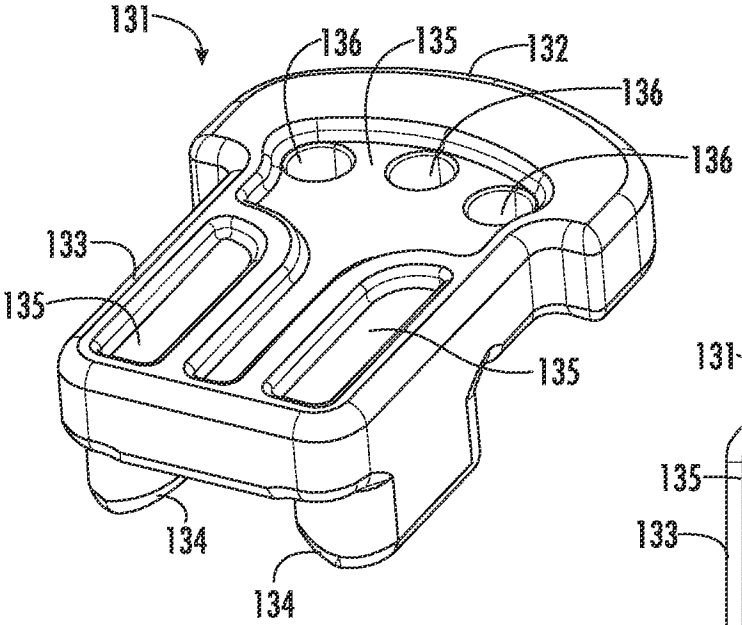
FIG. 3A is a detailed perspective view of the bumper of the upper receiver assembly of the upper assembly of FIG. 1A.
Figure 4A:
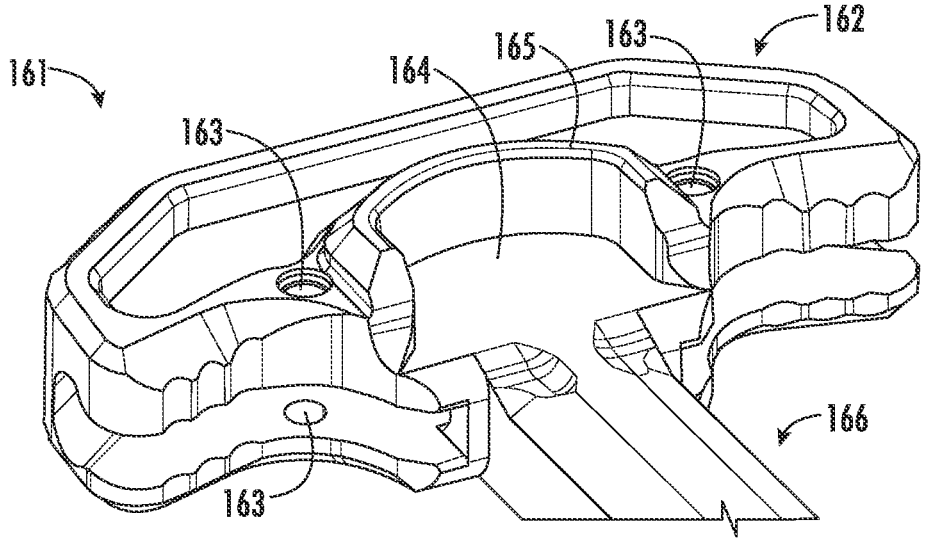
FIG. 4A is a detailed perspective view of a rearward portion of the charging handle body of the charging handle assembly of the upper assembly of FIG. 1A.
Figure 4B:
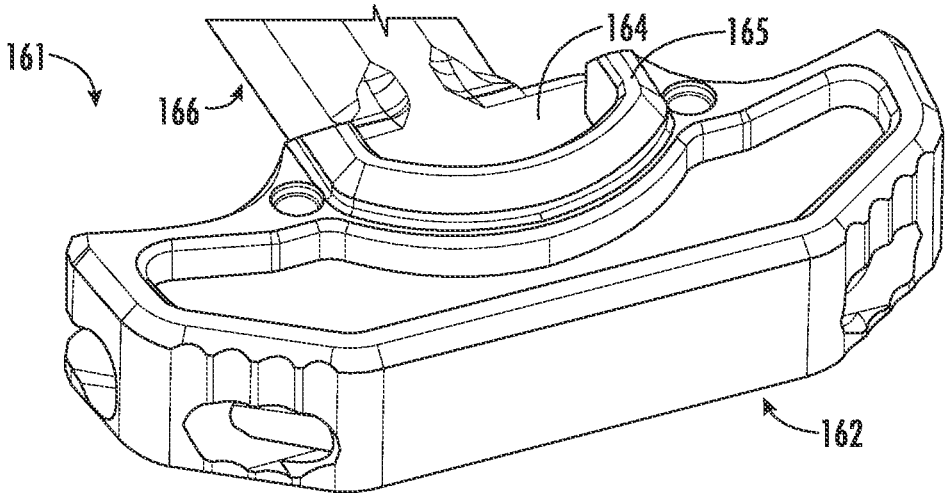
FIG. 4B is another detailed perspective view of the rearward portion of the charging handle body of FIG. 4A.
Figure 6B:
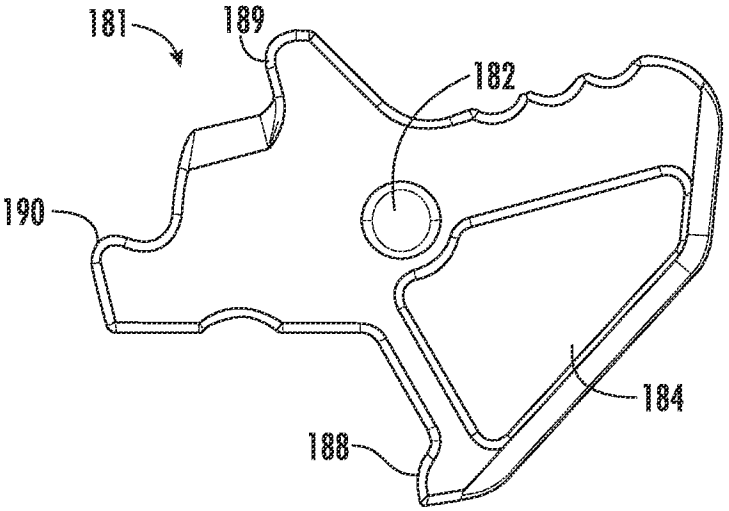
FIG. 6B is a top view of the second actuation wing of FIG. 6A.
Figure 6C:
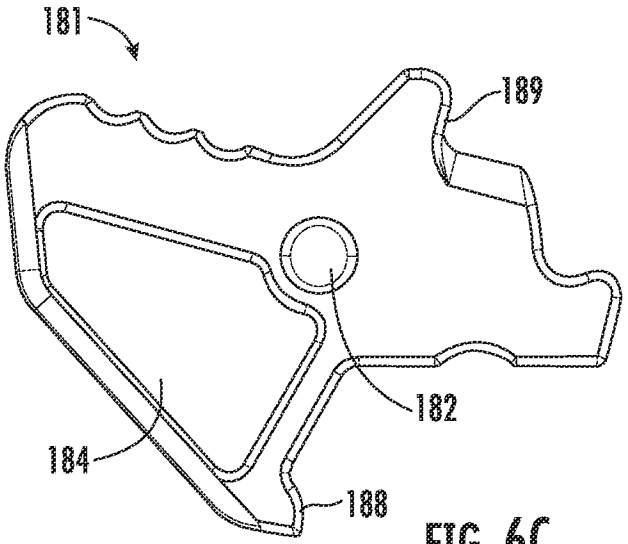
FIG. 6C is a bottom view of the second actuation wing of FIG. 6A.
Figure 6A:
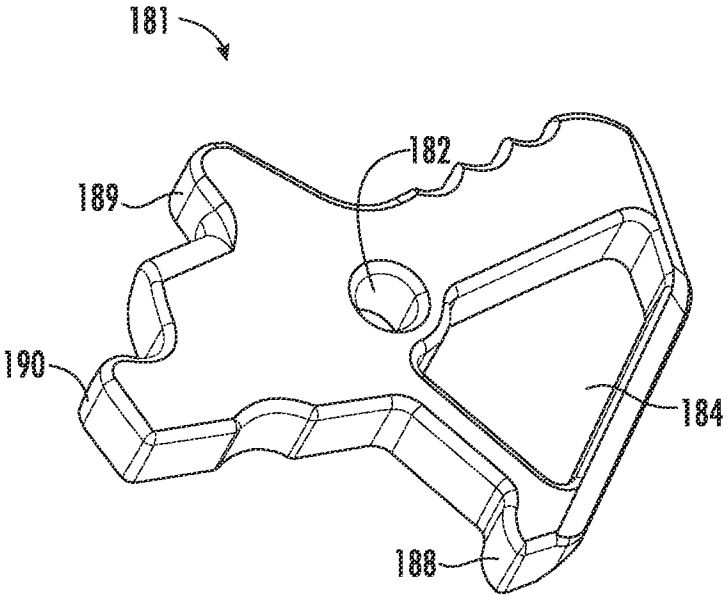
FIG. 6A is a detailed perspective view of the second actuation wing of the charging handle body of the charging handle assembly of the upper assembly of FIG. 1A.

As shown in FIGS. 1A-1J, the upper receiver assembly 110 may be provided as an elongated structure having a rearward end (also referred to as the breach end of a firearm) and a forward end (also referred to as the muzzle end of a firearm) disposed opposite one another along a longitudinal axis of the upper receiver assembly 110, a top side, a bottom side, and a pair of lateral sides. According to the illustrated example, the upper receiver assembly 110 may include an upper receiver body 111, a latch plate 121 (which also may be referred to as a "charging-handle latch plate" or a "latch-plate insert"), and a bumper 131 (which also may be referred to as a "charging-handle bumper" or a "preload member"). Additional components may be provided as part of the upper receiver assembly 110 in other examples. The upper receiver body 111 may include a top surface 112 disposed along the top side of the upper receiver body 111 and a pair of lateral surfaces 113 disposed along the respective lateral sides of the upper receiver body 111. As shown, the upper receiver body 111 may include a recess 114 defined in one of the lateral surfaces 113 and configured to receive at least a portion of the latch plate 121 therein. According to the illustrated example, the recess 114 may be defined in the lateral surface 113 along the left lateral side of the upper receiver body 111, although the recess 114 may be defined in other lateral surface 113 along the right lateral side of the upper receiver body 111 in other examples. As best seen in FIG. 1I, the recess 114 may extend downward from the top surface 112, with the recess 114 having an open end at the top surface 112 and a closed end disposed opposite the open end. In this manner, a portion of the latch plate 121 may be inserted into the recess 114 in a downward direction. The recess 114 may be sized and shaped to accommodate mating features of the latch plate 121. As shown, mating features of the recess 114 and the latch plate 121 may form a dovetail connection such that the latch plate 121 may be securely coupled to the upper receiver body 111. The upper receiver body 111 also may include a slot 115 disposed adjacent to and in communication with the recess 114, with the slot 115 extending in a rearward-forward direction. As described below, the slot 115 may allow a latch of the charging handle assembly 160 to pass therethrough when the charging handle assembly 160 is moved from a rearward position to a forward position.

As shown, the upper receiver body 111 also may include a cutout 116 defined in the top surface 112 and configured to receive at least a portion of the bumper 131 therein. As best seen in FIG. 1J, the cutout 116 may extend downward from the top surface 112 and forward from the rearward end of the upper receiver body 111, with the cutout 116 having an open end at the rearward end of the upper receiver body 111 and a closed end disposed opposite the open end. The cutout 116 may be sized and shaped to accommodate mating features of the bumper 131. As shown in FIG. 1I, when the bumper 131 is received within the cutout 116, the rearward end of the bumper 131 may extend rearward beyond the open end of the cutout 116 and the rearward end of the upper receiver body 111. This arrangement may facilitate compression of the bumper 131 between mating features of the upper receiver body 111 and the charging handle assembly 160 when the charging handle assembly 160 is in the forward position, prior to the latch engagement surface 177 engaging the latch-plate engagement surface 125 of the latch plate 121, as described below. In some examples, as shown, the upper receiver body 111 also may include a pair of holes 117 extending downward from the cutout 116 and configured to receive mating features of the bumper 131. According to the illustrated example, a plurality of threaded holes 118 may be used for removably coupling the top rail 158 to the upper receiver assembly 110 via a plurality of screws 159. In some examples, as shown, the threaded holes 118 may be formed in respective inserts that are press-fit into mating apertures defined in the upper receiver body 111. In other examples, the threaded holes 118 may be machined or otherwise formed directly in the upper receiver body 111.

As shown in FIGS. 2A-2D and 7A-7D, the latch plate 121 may be formed as a generally planar structure having a top side, a bottom side, a pair of lateral sides, an inner side (i.e., the side that faces the upper receiver body 111 when the latch plate 121 is received in the recess 114), and an outer side (i.e., the side that faces away from the upper receiver body 111 when the latch plate 121 is received in the recess 114). As shown, the latch plate 121 may include a plate portion 122, an extension portion 123 extending from the plate portion 122, an opening 124, a latch-plate engagement surface 125, and a ramp 126. As described below, the opening 124 may be configured to selectively receive a portion of a latch of the charging handle assembly 160 when the charging handle assembly 160 is in the forward position. The plate portion 122 may be configured to be received within the recess 114 of the upper receiver body 111, and the extension portion 123 may be configured to extend laterally outward from the recess 114. As best seen in FIG. 1J, when the latch plate 121 is disposed at least partially within the recess 114, the top surface of the latch plate 121 may be flush, or substantially flush, with the top surface 112 of the upper receiver body 111, the outer surface of the plate portion 122 may be flush, or substantially flush, with the lateral surface 113 of the upper receiver body 111, the extension portion 123 may extend laterally beyond the lateral surface 113 of the upper receiver body 111, and the ramp 126 may be aligned with the slot 115 of the upper receiver body 111. As shown in FIGS. 1I and 1J, the plate portion 122 of the latch plate 121 may be inserted downward into the recess 114 and may be sized and shaped to facilitate the dovetail connection between the latch plate 121 and the upper receiver body 111. In some examples, the connection between the latch plate 121 and the upper receiver body 111 may be provided as an interference fit, such as a press-fit connection, to facilitate retention of the latch plate 121 within the recess 114. When the top rail 158 is coupled to the upper receiver body 111, the top rail 158 may fully secure the latch plate 121 relative to the upper receiver body 111, preventing the latch plate 121 from backing out of the recess 114.

As shown, the extension portion 123 may at least partially surround the opening 124 such that the extension portion 123 at least partially defines the opening 124. The latch-plate engagement surface 125 also may define a portion of the opening 124. In some examples, as shown, the opening 124 may be a through opening extending entirely through the latch plate 121 from the outer surface to the inner surface thereof. In other examples, the opening 124 may extend from the outer surface toward but end short of the inner surface of the latch plate 121. In some examples, as shown, the opening 124 may have a rectangular shape with rounded corners, although other shapes of the opening 124 may be used in other examples. As further described below, the opening 124 may be configured to selectively receive a portion of the latch of the charging handle assembly 160 when the charging handle assembly 160 is in the forward position, and the latch-plate engagement surface 125 may be configured to engage a mating engagement surface of the latch when the portion of the latch is received within the opening 124. As shown, the ramp 126 may lead to the opening 124 and may be configured to deflect the latch as the latch engages the latch plate 121 and moves toward the opening 124 (i.e., as the charging handle assembly 160 is moved from the rearward position to the forward position). As discussed above, by providing the latch plate 121 as a separate component from the upper receiver body 111, desired geometry of the opening 124 and the latch-plate engagement surface 125 may be more economically machined as compared to manufacturing such features in the upper receiver body 111 itself. Moreover, the disclosed configuration allows the latch plate 121 and the upper receiver body 111 to be formed of different materials, which may provide a more robust design that minimizes wear of the engagement surfaces of the latch plate 121 and the latch of the charging handle assembly 160. For example, the upper receiver body 111 may be formed of a first material, such as a first metal, having a first hardness, and the latch plate 121 may be formed of a second material, such as a second metal, having a second hardness that is greater than the first hardness. More generally, the separate configuration of the latch plate 121 and the upper receiver body 111 may allow the latch plate 121 to be formed of various materials having different mechanical properties than the material of the upper receiver body 111. In various examples, the upper receiver body 111 may be formed of aluminum, and the latch plate 121 may be formed of steel, stainless steel, a different grade of aluminum, titanium, ceramic, or a plated softer material. In view of these benefits, after continued use of the upper assembly 100, inadvertent disengagement of the latch of the charging handle assembly 160 from the latch plate 121 of the upper receiver assembly 110 due, at least in part, to wear may be avoided. In some examples, the latch plate 121 may be formed of the same material as the upper receiver body 111 and may be removed and replaced if the latch plate 121 becomes significantly worn from use.

In some instances, the latch plate 121 may be coupled to the upper receiver body 111, either directly or indirectly, via means other than the illustrated recess 114. In this manner, the latch plate 121 may be coupled to an upper receiver body that lacks a mating recess, such as a standard upper receiver body. According to various examples, the latch plate 121 may be coupled directly to such an upper receiver body by one or more screws, one or more pins, one or more clips, one or more clamps, welding, brazing, press-fitting, or other means for mechanically coupling the latch plate 121 to the upper receiver body. In other examples, the latch plate 121 may be indirectly coupled to such an upper receiver body by the latch plate 121 being coupled to or otherwise being held in place by another portion of the upper assembly, such as a top rail thereof, a lower assembly of the firearm (e.g., press fit into a dovetail slot from the bottom of the upper receiver, opposite the rail, and held in place, in part, by the lower assembly when coupled to the upper receiver), or an interface between the lower assembly and the upper assembly of the firearm. Various configurations and techniques may be used for coupling the latch plate 121 to an upper receiver body in original-manufacture and retrofit applications.

As shown in FIGS. 3A-3D, the bumper 131 may be formed as an elongated structure having a rearward end, a forward end, a top side (i.e., the side that faces away from the upper receiver body 111 when the bumper 131 is received in the cutout 116), a bottom side (i.e., the side that faces the upper receiver body 111 when the bumper 131 is received in the cutout 116), and a pair of lateral sides. As shown, the bumper 131 may include a rearward portion 132, a forward portion 133, one or more protrusions 134, one or more recesses 135, and one or more holes 136. In some examples, as shown, the bumper 131 may be formed of a resiliently compressible material and configured to be resiliently compressed between the upper receiver body 111 and the charging handle assembly 160 when the charging handle assembly 160 is in the forward position prior to the latch engagement surface 177 engaging the latch-plate engagement surface 125 of the latch plate 121, as described below. The bumper 131 may be formed of a material that is chemically and mechanically resistant. In some examples, the bumper 131 may be formed of an elastic and resilient material. In some examples, the bumper 131 may be formed of a thermoplastic. In some examples, the bumper 131 may be formed of silicone, although other suitable resiliently compressible materials may be used in other examples. As shown in FIG. 1I, when the bumper 131 is coupled to the upper receiver body 111, the forward portion 133 may be received within the cutout 116, and the rearward portion 132 may extend rearward from the cutout 116 and beyond the rearward end of the upper receiver body 111. The protrusions 134 may extend downward from the forward portion 133 and may be configured to be received within the respective holes 117 of the upper receiver body 111. In some examples, the protrusions 134 may be sized and shaped to be slightly larger than the holes 117 such that insertion of the protrusions 134 into the holes 117 may cause the protrusions 124 to be slightly compressed, thereby facilitating positioning and coupling of the bumper 131 to the upper receiver body 111. In some examples, as shown, the bumper 131 may include a pair of the protrusions 134, although fewer or more of the protrusions 134 may be used in other examples. The protrusions 134 may be of a size to extend through the holes 17 and into the interior of the upper receiver and engage a top side surface of the shaft portion of the charging handle so as to bias the charging handle downward, thereby mitigating exhaust gas from the discharge of the firearm from escaping the interior of the upper receiver through the opening at the rear of the upper receiver that receives the charging handle. The rearward portion 132 may be sized and shaped to cooperate with mating features of the charging handle assembly 160 that engage the bumper 131 when the charging handle assembly 160 is in the forward position, as described below.

As further described below, the bumper 131 may be configured to be resiliently compressed between the upper receiver body 111 and the charging handle assembly 160 when the charging handle assembly 160 is in the forward position. The recesses 135 and the holes 136 may be configured to provide a desired degree of compression of the bumper 131 between the upper receiver body 111 and the charging handle assembly 160 and thus a desired amount of force biasing the charging handle assembly 160 rearward away from the upper receiver body 111. In this manner, the size, shape, and arrangement of the recesses 135 and the holes 136 may vary in different examples to provide the desired compression and force. In some examples, as shown, three of the recesses 135 may be defined in the top surface of the bumper 131, although more or fewer of the recesses 135 and different arrangements of the recesses 135 may be used in other examples. In some examples, as shown, three of the holes 136 may be provided, although more or fewer of the holes 136 may be used in other examples. In some examples, as shown, the holes 136 may be through holes extending through the rearward portion 132 from the top surface to the bottom surface of the bumper 131, although different types of holes, such as blind holes, and different arrangements of the holes 136 may be used in other examples. In some examples, as shown, when the bumper 131 is coupled to the upper receiver body 111, the top surface of the bumper 131 may extend upward beyond the top surface 112 of the upper receiver body 111. In this manner, when the top rail 158 is coupled to the upper receiver body 111, the bumper 131 may be slightly vertically compressed between the top rail 158 and the upper receiver body 111. It will be appreciated that this arrangement and pre-compression of the bumper 131 may influence the longitudinal compression of the bumper 131 between the upper receiver body 111 and the charging handle assembly 160 and the resulting biasing force provided by the bumper 131 when the charging handle assembly 160 is in the forward position. In other examples, the top surface of the bumper 131 may be flush with the top surface 112 of the upper receiver body 111 such that the bumper 131 is not compressed between the top rail 158 and the upper receiver body 111.

Although the bumper 131 may be provided as a single component formed of a resiliently compressible material according to the illustrated example, the bumper 131 may have other configurations and may be formed of other types of materials in accordance with other examples of the disclosure, while providing the same biasing functions described herein. In some instances, for example, the bumper 131 may include a spring that biases the charging handle assembly 160 rearward and/or downward relative to the upper receiver body 111. In such instances, the spring may be formed of metal or another suitable material. In some examples, the bumper 131 also may include an additional component that interacts with the spring and the charging handle assembly 160, such as a plunger or the like. In this manner, the bumper 131 may include multiple components that cooperate with one another, the upper receiver body 111, and the charging handle assembly 160 to provide the biasing function described herein. Various possible configurations of the bumper 131 and suitable materials for the components thereof may be used in different examples.

The barrel assembly 140 may be formed as an elongated structure having a rearward end and a forward end disposed opposite one another along a longitudinal axis of the barrel assembly 140. The barrel assembly 140 may be coupled to the upper receiver assembly 110 and extend forward from the upper receiver assembly 110. As shown, the barrel assembly 140 may include a barrel body 141 defining a barrel bore configured for receiving projectiles of cartridges discharged using the firearm. In some examples, the barrel assembly 140 also may include a barrel extension that is coupled to the barrel body 141 by a pin or other means of attachment. In some examples, the barrel assembly 140 may be coupled to the upper receiver assembly 110 by a barrel nut or other means of attachment. In some examples, as shown, the upper assembly 100 may include a muzzle brake 142 disposed at the forward end of the barrel assembly 140.

The gas block assembly 150 may be configured to receive and direct high-pressure gas from cartridges discharged using the firearm to automatically cycle the action of the firearm. As shown, the gas block assembly 150 may include a gas block 151 coupled to the barrel assembly 140 and configured to receive a portion of the high-pressure gas from the barrel bore of the barrel body 141. In some examples, the gas block 151 may be adjustable and adjustably coupled to the barrel body 141 via one or more screws, nuts, or other means of attachment. The gas block assembly 150 also may include a gas tube coupled to the gas block 151 and configured to receive and direct the high-pressure gas rearward to drive movement of the bolt carrier group during cycling of the action.

The handguard assembly 154 may be formed as an elongated, hollow structure having a rearward end and a forward end disposed opposite one another along a longitudinal axis of the handguard assembly 154. The handguard assembly 154 may be coupled to the upper receiver assembly 110 and extend forward from the upper receiver assembly 110. As shown, the handguard assembly 154 may extend around the barrel assembly 140 and may be configured to be grasped by an operator during use of the firearm. The handguard assembly 154 may include a handguard body 155 defining a central passage through which the barrel assembly 140 extends. As shown, the handguard body 155 may include a plurality of openings extending from the central passage to the outer surfaces of the handguard body 155. According to the illustrated example, a plurality of threaded holes 156 may be provided for removably coupling one or more accessories as well as for removably coupling the top rail 158 to the handguard assembly 154 via a plurality of the screws 159. In some examples, as shown, the threaded holes 156 may be formed in respective inserts that are press-fit into mating apertures defined in the handguard body 155. In other examples, the threaded holes 156 may be machined or otherwise formed directly in the handguard body 155.

As shown in FIGS. 1A-1F and 1K-1M, the charging handle assembly 160 may be provided as an elongated structure having a rearward end and a forward end disposed opposite one another along a longitudinal axis of the charging handle assembly 160, a top side, a bottom side, and a pair of lateral sides. According to the illustrated example, the charging handle assembly 160 may include a charging handle body (which also may be referred to as a "charging handle" or a "main body") 161, a first actuation wing (which also may be referred to as a "latch wing," a "left wing," or a "first wing") 171, second actuation wing (which also may be referred to as a "cooperating wing," a "right wing," or a "second wing") 181, a first pin (which also may be referred to as a "first roll pin") 191, a second pin (which also may be referred to as a "second roll pin") 192, a first plunger (which also may be referred to as a "first spring plunger") 193, a second plunger (which also may be referred to as a "second spring plunger") 194, and a first spring (which also may be referred to as a "compression spring" or a "coil spring") 195, and a second spring (which also may be referred to as a "compression spring" or a "coil spring") 196. Additional components may be provided as part of the charging handle assembly 160 in other examples. As shown, the charging handle assembly 160 may have an ambidextrous configuration, allowing for actuation of the charging handle assembly 160 from either of the lateral sides thereof. As shown, the charging handle assembly 160 may be received at least partially within the upper receiver assembly 110 and movable relative to the upper receiver assembly 110 to manually cycle the action of the firearm. In particular, the charging handle assembly 160 may be configured to translate relative to the upper receiver assembly 110 between the forward position and the rearward position to cycle the action, with the charging handle assembly 160 being spring-biased, via the bolt carrier group, to the forward position. During manual cycling of the action, the charging handle assembly 160 may be pulled rearward from the forward position by an operator to open the action and then released such that the charging handle assembly 160 advances back into the upper receiver assembly 110 to the forward position, via force provided by the compressed spring, to close the action.

As shown in FIGS. 1K-1M, 4A, 4B, and 7A-7D, the charging handle body 161 may be provided as an elongated structure having a rearward end and a forward end disposed opposite one another along a longitudinal axis of the charging handle body 161, a top side, a bottom side, and a pair of lateral sides. The charging handle body 161 may include a handle portion 162 and a shaft portion 166, with the handle portion 162 extending from the rearward end of the charging handle body 161 to the shaft portion 166, and with the shaft portion 166 extending from the forward end of the charging handle body 161 to the handle portion 162. As shown in FIGS. 1A-1D, when the charging handle assembly 160 is in the forward position, the shaft portion 166 may be received within the upper receiver assembly 110, and the handle portion 162 may extend rearward from the upper receiver assembly 110.

The handle portion 162 may be configured to be grasped by an operator to facilitate pulling the charging handle body 161 and the overall charging handle assembly 160 rearward from the forward position to the rearward position. Accordingly, the handle portion 162 may be ergonomically shaped and may include ribs, grooves, and/or other features to facilitate grasping of the handle portion 162. In some examples, as shown, the charging handle body 161 may have a T-shaped configuration, with the handle portion 162 including a pair of arms extending laterally in opposite directions from one another. As shown, the handle portion 162 may be formed as a partially hollow structure, including a plurality of recesses or holes, which may be interconnected, configured to receive respective portions of the first actuation wing 171, the second actuation wing 181, the first pin 191, the second pin 192, the first plunger 193, the second plunger 194, the first spring 195, and the second spring 196 and allow for intended movement, if any, of such components relative to the handle portion 162 during use of the charging handle assembly 160. As shown, the handle portion 162 may include a first pair of pin holes 163 configured to receive the first pin 191 and a second pair of pin holes 172 configured to receive the second pin 192. In some examples, the first pin 191 and the second pin 192 may be press-fit into the respective pin holes 172. In some examples, as shown, the first pin 191 and the second pin 192 may be coiled pins, although other types of pins or other types of fasteners may be used in other examples. As shown, the handle portion 162 also may include a cutout 164 defined in the top surface of the handle portion 162 and configured to receive at least part of the bumper 131 therein when the charging handle assembly 160 is in the forward position. The cutout 164 may be defined at least partially by a wall 165 that wraps at least partially around the cutout 164. As shown, the wall 165 may be formed as a ridge having a contoured shape that corresponds to the shape of the rearward end of the bumper 131, in particular the rearward portion 132 thereof. As further described below, the wall 165 may engage the bumper 131 when the charging handle assembly 160 is in the forward position such that the bumper 131 is resiliently compressed between the upper receiver body 111 and the wall 165. In some examples, the wall 165 may be covered with a rubber or silicon material similar to that described above for bumper 131 so as to function as the charging handle bumper, for instance, when the upper received does not include a bumper 131. Thus, the covered wall 165 may be compressed against the mating features of the upper receiver body 111 when the charging handle assembly 160 is in the forward position, prior to the latch engagement surface 177 engaging the latch-plate engagement surface 125 of the latch plate 121.

The shaft portion 166 of the charging handle body 161 may be configured to be received within a mating receptacle of the upper receiver body 111 when the charging handle assembly 160 is in the forward position and to engage the bolt carrier group to facilitate movement of the bolt carrier group during manual cycling of the action. Accordingly, the shaft portion 166 may be shaped and configured to correspond to the shape and configuration of the mating receptacle and to facilitate smooth translation of the charging handle body 161 relative to the upper receiver body 111. As shown, the shaft portion 166 may include a hook 167 disposed as the forward end of the charging handle body 161 and configured to engage the bolt carrier group for moving the bolt carrier group rearward and then moving forward along with the bolt carrier group during manual cycling of the action.

Figure 7A:
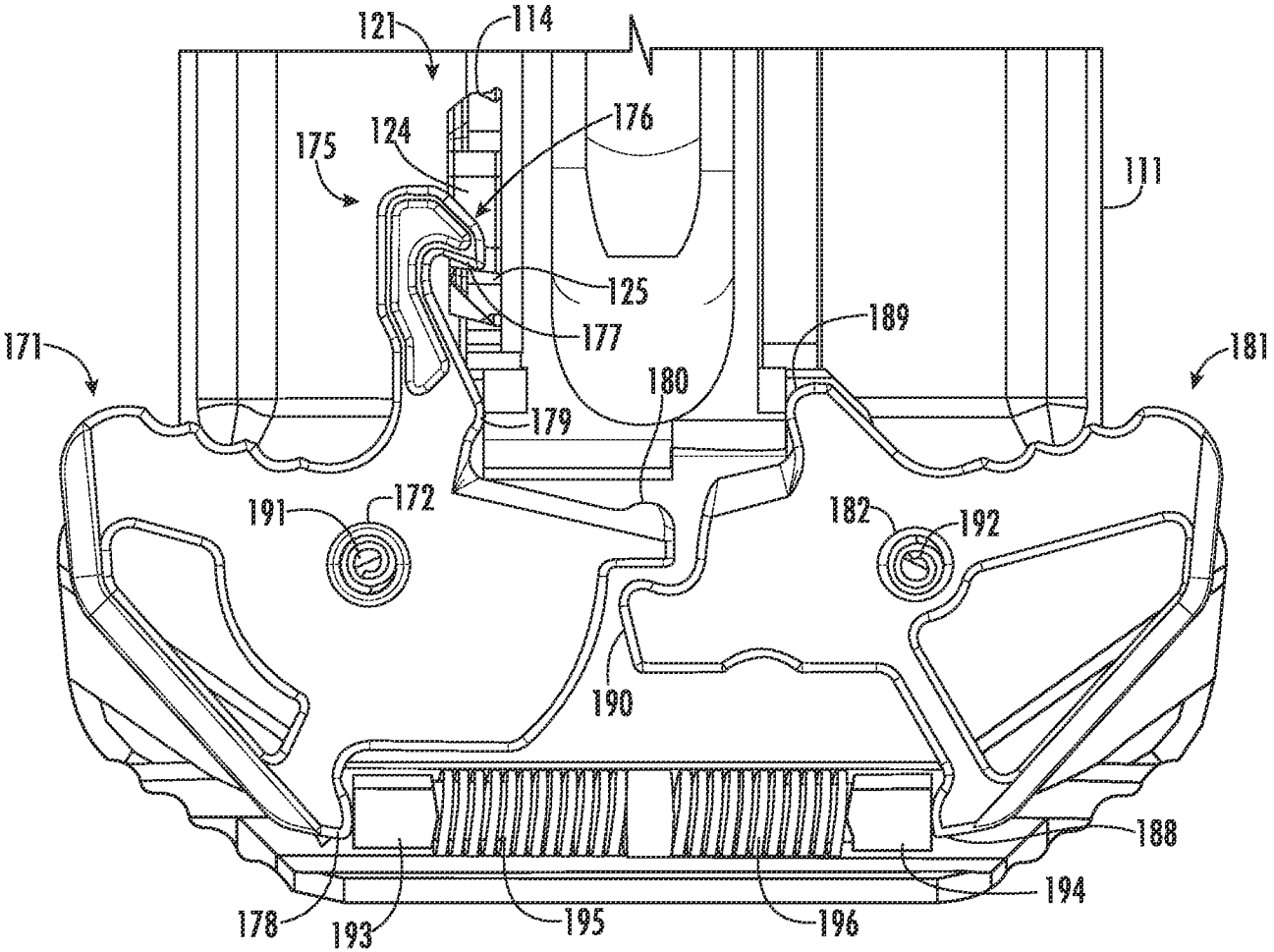
FIG. 7A is a detailed cross-sectional top view of rearward portions of the upper receiver assembly and the charging handle assembly of the upper assembly of FIG. 1A, showing the charging handle assembly in the forward position, the first actuation wing in a first position, and the second actuation wing in a third position.
Figure 7B:
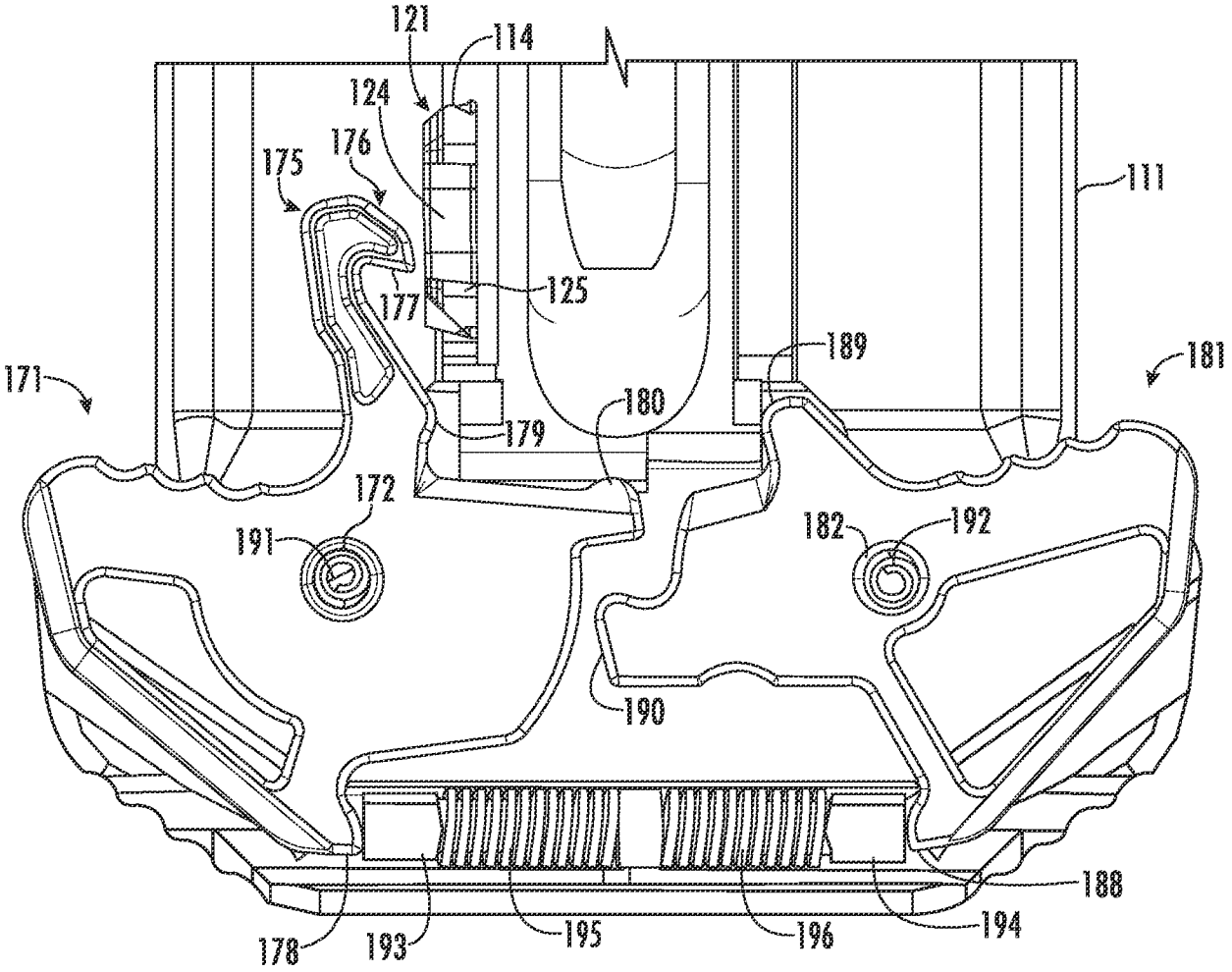
FIG. 7B is a detailed cross-sectional top view of rearward portions of the upper receiver assembly and the charging handle assembly of the upper assembly of FIG. 1A, showing the charging handle assembly in the forward position, the first actuation wing in a second position, and the second actuation wing in the third position.
Figure 7C:
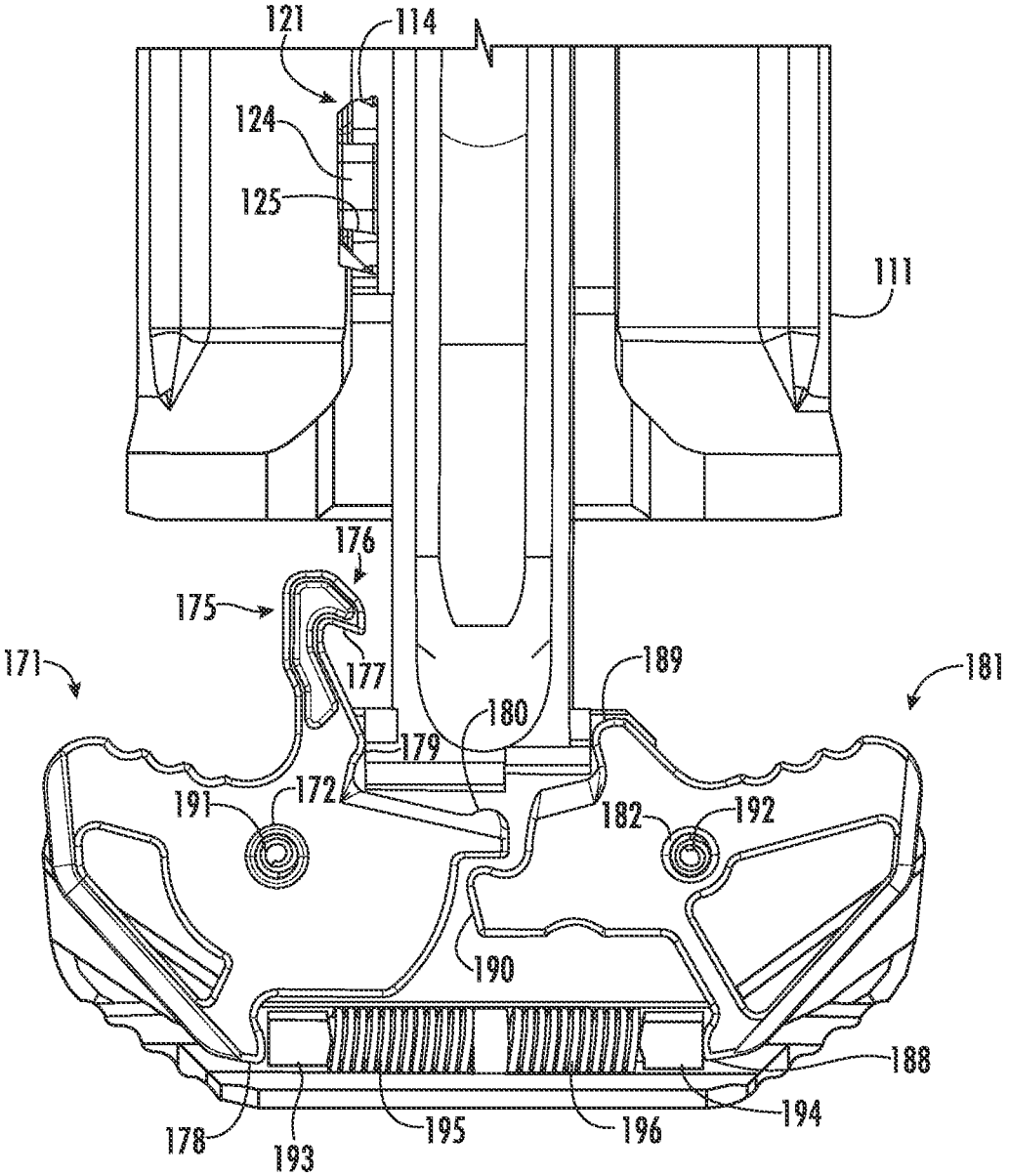
FIG. 7C is a detailed cross-sectional top view of rearward portions of the upper receiver assembly and the charging handle assembly of the upper assembly of FIG. 1A, showing the charging handle assembly in a rearward position, the first actuation wing in the first position, and the second actuation wing in the third position.
Figure 7D:
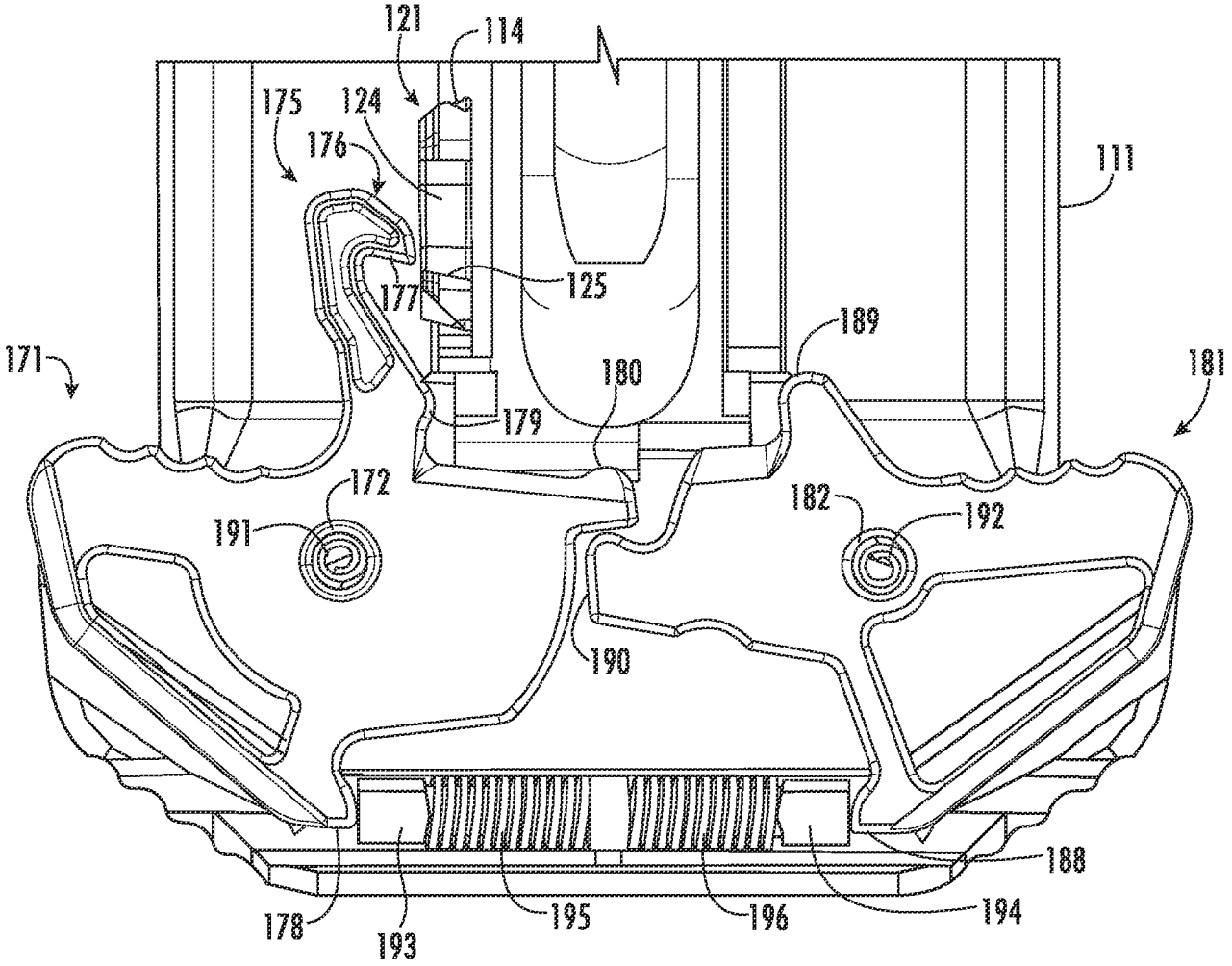
FIG. 7D is a detailed cross-sectional top view of rearward portions of the upper receiver assembly and the charging handle assembly of the upper assembly of FIG. 1A, showing the charging handle assembly in the forward position, the first actuation wing in the second position, and the second actuation wing in a fourth position.

As shown in FIGS. 1K-1M and FIGS. 5A-5C, the first actuation wing 171 may be formed as a generally planar structure having a top side, a bottom side, a forward end (i.e., the end extending forward away from the handle portion 162), a rearward end (i.e., the end extending rearward into the handle portion 162), an inner end (i.e., the end extending laterally into the handle portion 162), and an outer end (i.e., the end extending laterally away from the handle portion 162). As shown, the first actuation wing 171 may include a pin hole 172, one or more recesses 173, one or more holes 174, a latch arm 175 having a latch 176 with a latch engagement surface 177, a plunger engagement portion 178, a stop portion 179, and a cooperating engagement portion 180. The first actuation wing 171 may be rotatably coupled to the handle portion 162 and configured to rotate relative to the handle portion 162 about a first rotational axis. As shown, the first actuation wing 171 may be rotatably coupled to the handle portion 162 via the first pin 191 extending through the pin hole 172 and configured to rotate about the first rotational axis defined by the first pin 191, the pin hole 172, and the pin holes 163. The first actuation wing 171 may be configured to rotate between a first position, as shown in FIGS. 7A and 7C, and a second position, as shown in FIGS. 7B and 7D. The recesses 173 and the holes 174 may be provided to position a center of mass of the first actuation wing 171 in a desired manner. In particular, the overall size and shape of the first actuation wing 171 and the recesses 173 and the holes 174 thereof may be configured such that the center of mass of the first actuation wing 171 is centered within the pin hole 172 and thus is disposed along the first rotational axis of the first actuation wing 171. As discussed above, by positioning the center of mass of the first actuation wing 171 along the first rotational axis, the first actuation wing 171 may be balanced. In this manner, inadvertent disengagement of the latch 176 from the upper receiver assembly 110 may be avoided because the first actuation wing 171 may remain stationary, or substantially stationary, relative to the handle portion 162 and the upper receiver assembly 110 even when the firearm recoils, vibrates, or otherwise moves during discharge of a cartridge.

As shown, the latch arm 175 of the first actuation wing 171 may extend forward away from the handle portion 162, and the latch 176 thereof may extend laterally toward the shaft portion 163. The latch 176 may be formed as a hook, as shown, with the latch engagement surface 177 extending at a negative angle relative to a direction perpendicular to the longitudinal axis of the charging handle body 161 (which extends in the forward-rearward direction). Various suitable values for the negative angle of the latch engagement surface 177 may be used. In certain examples, the negative angle of the latch engagement surface 177 may be within a range of one (1) to thirty (30) degrees, within a range of five (5) to twenty (20) degrees, or approximately fifteen (15) degrees. As shown, the negative angle of the latch engagement surface 177 generally may correspond to the negative angle of the latch-plate engagement surface 125 of the latch plate 121, although the values of the negative angles of the surfaces 177, 125 may be different from one another to provide line contact therebetween. In other words, the latch engagement surface 177 may extend at a first negative angle, and the latch-plate engagement surface 125 may extend at a second negative angle that is different than, such as less than, the first negative angle. In some examples, as shown, a magnitude of the difference between the first negative angle and the second negative angle may be relatively small, such as less than three (3) degrees, but sufficient to ensure line contact (rather than full surface contact) between the surfaces 177, 125. By providing the latch engagement surface 177 extending at a negative angle, even if some relative movement occurs between the latch 176 and the latch plate 121, some engagement between the latch engagement surface 177 and the latch-plate engagement surface 125 may generate a force to induce more engagement therebetween. In this manner, the configuration of the latch 176 and the latch plate 121 may inhibit inadvertent disengagement of the latch 176 from the upper receiver assembly 110.

As shown, the plunger engagement portion 178 of the first actuation wing 171 may extend rearward into the handle portion 162 and may be configured to engage the first plunger 193. In particular, the plunger engagement portion 178 may be configured for engaging one end of a head portion of the first plunger 193, while the first spring 195 may engage the other end of the head portion. In this manner, the first spring 195, the first plunger 193, and the plunger engagement portion 178 may cooperate such that the first actuation wing 171 is biased to the first position. As shown, the plunger engagement portion 178 may be shaped and contoured such that the plunger engagement portion 178 maintains engagement with the first plunger 193 as the first actuation wing 171 moves throughout its range of rotation between the first position and the second position. As shown, the stop portion 179 of the first actuation wing 171 may extend laterally toward the shaft portion 166 of the charging handle body 161 and may be configured to engage the lateral surface of the shaft portion 166 when the first actuation wing 171 is in the first position. In this manner, engagement between the stop portion 179 and the shaft portion 166 may define the first position of the first actuation wing 171, in which the latch 176 remains spaced apart from the shaft portion 166. Consequently, the stop portion 179 may be configured to control how far the latch 176 is inserted into the opening 124 of the latch plate 121 when the charging handle assembly 160 is in the forward position and the first actuation wing 171 is in the first position. It will be appreciated that the stop portion 179 may be sized and shaped to allow a desired amount of insertion of the latch 176 into the opening 124 of the latch plate 121 to provide a suitable amount of engagement between the latch engagement surface 176 and the latch-plate engagement surface 125 to inhibit inadvertent disengagement. As shown, the cooperating engagement portion 180 of the first actuation wing 171 may extend laterally into the handle portion 162 and may be configured to selectively engage a corresponding portion of the second actuation wing 181 when the charging handle assembly 160 is actuated using the second actuation wing 181, as described below.

As shown in FIGS. 1K-1M and FIGS. 6A-6C, the second actuation wing 181 may be formed as a generally planar structure having a top side, a bottom side, a forward end (i.e., the end extending forward away from the handle portion 162), a rearward end (i.e., the end extending rearward into the handle portion 162), an inner end (i.e., the end extending laterally into the handle portion 162), and an outer end (i.e., the end extending laterally away from the handle portion 162). As shown, the second actuation wing 181 may include a pin hole 182, one or more recesses, one or more holes 184, a plunger engagement portion 188, a stop portion 189, and a cooperating engagement portion 190. The second actuation wing 181 may be rotatably coupled to the handle portion 162 and configured to rotate relative to the handle portion 162 about a second rotational axis extending parallel to the first rotational axis of the first actuation wing 171. As shown, the second actuation wing 181 may be rotatably coupled to the handle portion 162 via the second pin 192 extending through the pin hole 182 and configured to rotate about the second rotational axis defined by the second pin 192, the pin hole 182, and the pin holes 163. The second actuation wing 181 may be configured to rotate between a third position, as shown in FIGS. 7A-7C, and a fourth position, as shown in FIG. 7D. The recesses and the holes 184 may be provided to position a center of mass of the second actuation wing 181 in a desired manner. In particular, the overall size and shape of the second actuation wing 181 and the recesses and the holes 184 thereof may be configured such that the center of mass of the second actuation wing 181 is centered within the pin hole 182 and thus is disposed along the second rotational axis of the second actuation wing 181. By positioning the center of mass of the second actuation wing 181 along the second rotational axis, the second actuation wing 181 may be balanced. In this manner, undesired movement of the second actuation wing 181, which might cause the second actuation wing 181 to engage and move the first actuation wing 171, may be avoided (and thus inadvertent disengagement of the latch 176 from the upper receiver assembly 110 may be avoided) because the second actuation wing 181 may remain stationary, or substantially stationary, relative to the handle portion 162 and the upper receiver assembly 110 even when the firearm recoils, vibrates, or otherwise moves during discharge of a cartridge.

As shown, the plunger engagement portion 188 of the second actuation wing 181 may extend rearward into the handle portion 162 and may be configured to engage the second plunger 194. In particular, the plunger engagement portion 188 may be configured for engaging one end of a head portion of the second plunger 194, while the second spring 196 may engage the other end of the head portion. In this manner, the second spring 196, the second plunger 194, and the plunger engagement portion 188 may cooperate such that the second actuation wing 181 is biased to the third position. As shown, the plunger engagement portion 188 may be shaped and contoured such that the plunger engagement portion 188 maintains engagement with the second plunger 194 as the second actuation wing 181 moves throughout its range of rotation between the third position and the fourth position. As shown, the stop portion 189 of the second actuation wing 181 may extend laterally toward the shaft portion 166 of the charging handle body 161 and may be configured to engage the lateral surface of the shaft portion 166 when the second actuation wing 181 is in the third position. In this manner, engagement between the stop portion 189 and the shaft portion 166 may define the third position of the second actuation wing 181, in which a gap exists between the cooperating engagement portion 190 of the second actuation wing 181 and the cooperating engagement portion 180 of the first actuation wing 171. Consequently, the stop portion 189 may be configured such that a position of the first engagement wing 171 is not affected by the second actuation wing 181 when the second actuation wing 181 is in the third position. It will be appreciated that the stop portion 189 may be sized and shaped to provide a suitable gap between the cooperating engagement portion 190 of the second actuation wing 181 and the cooperating engagement portion 180 of the first actuation wing 171. As shown, the cooperating engagement portion 190 of the second actuation wing 181 may extend laterally into the handle portion 162 and may be configured to selectively engage the cooperating engagement portion 180 of the first actuation wing 171 when the charging handle assembly 160 is actuated using the second actuation wing 181. In particular, as the second actuation wing 181 is rotated from the third position to the fourth position, the cooperating engagement portion 190 may engage the cooperating engagement portion 180 and cause the first actuation wing 171 to rotate from the first position to the second position. In some examples, the cooperating engagement portion 180 and the cooperating engagement portion 190 are separated by a gap when the second actuating wing 181 is not actuated, that is, when the second actuating wing 181 is in the third position, as shown in FIGS. 7A-7C. This is intended to prevent rotation of the second actuating wing 181 from imparting unwanted forces on the first actuating wing 171 when the second actuating wing 181 is not being actuated by the user.

According to the illustrated example, the first plunger 193, the second plunger 194, the first spring 195, and the second spring 196 together may form a biasing mechanism configured to bias the first actuation wing 171 to the first position and to bias the second actuation wing 181 to the third position. Various other configurations of the biasing mechanism may be used in other examples, which may include one or more plungers and/or one or more springs arranged and configured in a manner different from the illustrated example.

FIGS. 7A-7D illustrate examples of actuating the charging handle assembly 160. As discussed above, the charging handle assembly 160 may have an ambidextrous configuration, allowing the charging handle assembly 160 to be actuated along the left side thereof using the first actuation wing 171 or along the right side thereof using the second actuation wing 181. FIGS. 7A and 7B show actuation using the first actuation wing 171. With the first actuation wing 171 in the first position, as shown in FIG. 7A, an operator may grasp the handle portion 162 and the exposed portion of the first actuation wing 171 extending forward therefrom, causing the first actuation wing 171 to rotate from the first position to the second position, as shown in FIG. 7B. In this manner, the latch 176 may disengage the opening 124 of the latch plate 121, allowing the operator to pull the charging handle assembly 160 rearward relative to the upper receiver assembly 110 from the forward position to the rearward position, as shown in FIG. 7C. FIGS. 7A and 7D show actuation using the second actuation wing 181. With the second actuation wing 181 in the third position, as shown in FIG. 7A, an operator may grasp the handle portion 162 and the exposed portion of the second actuation wing 181 extending forward therefrom, causing the second actuation wing 181 to rotate from the third position to the fourth position and thereby causing the first actuation wing 171 to rotate from the first position to the second position, as shown in FIG. 7D. In this manner, the latch 176 may disengage the opening 124 of the latch plate 121, allowing the operator to pull the charging handle assembly 160 rearward relative to the upper receiver assembly 110 from the forward position to the rearward position, as shown in FIG. 7C.

Although specific examples of the disclosure have been described, numerous other modifications and alternative examples are within the scope of the disclosure. For example, any of the functionalities described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

We claim:

1. A charging handle assembly for a firearm, the charging handle assembly comprising:

a charging handle body comprising a handle portion and a shaft portion;

a first actuation wing rotatably coupled to the handle portion and configured to rotate about a first rotational axis between a first position and a second position, the first actuation wing comprising a latch configured to selectively engage an upper receiver assembly of the firearm, and the first actuation wing having a center of mass disposed along the first rotational axis; and a biasing mechanism engaging the first actuation wing and biasing the first actuation wing to the first position.

2. The charging handle assembly of claim 1, wherein the first actuation wing is rotatably coupled to the handle portion by a first pin extending through a pin hole of the first actuation wing, and wherein the center of mass of the first actuation wing is disposed within the pin hole.

3. The charging handle assembly of claim 1, wherein the first actuation wing comprises a plurality of recesses defined such that the center of mass of the first actuation wing is disposed along the first rotational axis.

4. The charging handle assembly of claim 1, wherein the handle portion comprises a recessed area, and wherein the first actuation wing and the biasing mechanism are disposed at least partially within the recessed area.

5. The charging handle assembly of claim 1, wherein the biasing mechanism comprises:

a first plunger engaging the first actuation wing; and a first spring engaging the first plunger and biasing the first plunger toward the first actuation wing.

6. The charging handle assembly of claim 5, wherein the first plunger and the first spring extend in a direction perpendicular to a longitudinal axis of the charging handle body.

7. The charging handle assembly of claim 1, wherein the latch comprises a latch engagement surface configured to engage an upper receiver assembly, and wherein the latch engagement surface defines a negative angle relative to a direction perpendicular to a longitudinal axis of the charging handle body.

8. The charging handle assembly of claim 7, wherein the negative angle of the latch engagement surface is within a range of 1 degree to 30 degrees.

9. The charging handle assembly of claim 1, further comprising a bumper coupled to the handle portion and configured to bias the handle portion rearward relative to an upper receiver assembly when the latch engages the upper receiver assembly.

10. The charging handle assembly of claim 9, wherein the bumper is formed of a resiliently compressible material and configured to be resiliently compressed between the handle portion and the upper receiver assembly when the latch engages the upper receiver assembly.

11. The charging handle assembly of claim 1, further comprising a second actuation wing rotatably coupled to the handle portion and configured to rotate about a second rotational axis between a third position and a fourth position.

12. The charging handle assembly of claim 11, wherein the second rotational axis extends parallel to the first rotational axis, wherein the second actuation wing has a center of mass disposed along the second rotational axis, and wherein the biasing mechanism engages the second actuation wing and biases the second actuation wing to the third position.

13. The charging handle assembly of claim 12, wherein the first actuation wing is rotatably coupled to the handle portion by a first pin extending through a first pin hole of the first actuation wing, wherein the center of mass of the first actuation wing is disposed within the first pin hole, wherein the second actuation wing is rotatably coupled to the handle portion by a second pin extending through a second pin hole of the second actuation wing, and wherein the center of mass of the second actuation wing is disposed within the second pin hole.

14. The charging handle assembly of claim 12, wherein the first actuation wing comprises a plurality of recesses defined such that the center of mass of the first actuation wing is disposed along the first rotational axis, and wherein the second actuation wing comprises a plurality of recesses defined such that the center of mass of the second actuation wing is disposed along the second rotational axis.

15. The charging handle assembly of claim 11, wherein the handle portion comprises a recessed area, and wherein the first actuation wing, the second actuation wing, and the biasing mechanism are disposed at least partially within the recessed area.

16. The charging handle assembly of claim 11, wherein:

the first actuation wing further comprises a first cooperating engagement portion;

the second actuation wing comprises a second cooperating engagement portion; and rotation of the second actuation wing from the third position to the fourth position causes the second cooperating engagement portion to engage the first cooperating engagement portion and rotate the first actuation wing from the first position to the second position.

17. The charging handle assembly of claim 16, wherein the biasing mechanism comprises:

a first plunger engaging the first actuation wing;

a second plunger engaging the second actuation wing;

a first spring engaging the first plunger and biasing the first plunger toward the first actuation wing; and a second spring engaging the second plunger and biasing the second plunger toward the second actuation wing.

18. The charging handle assembly of claim 17, wherein the first plunger, the second plunger, the first spring, and the second spring extend in a direction perpendicular to a longitudinal axis of the charging handle body.

19. A charging handle assembly for a firearm, the charging handle assembly comprising:

a charging handle body comprising a handle portion and a shaft portion;

a first actuation wing rotatably coupled to the handle portion and configured to rotate about a first rotational axis between a first position and a second position, the first actuation wing comprising a latch configured to selectively engage an upper receiver assembly of the firearm, and the first actuation wing having a center of mass disposed along the first rotational axis;

a second actuation wing rotatably coupled to the handle portion and configured to rotate about a second rotational axis between a third position and a fourth position, the second actuation wing having a center of mass disposed along the second rotational axis; and a biasing mechanism engaging the first actuation wing and the second actuation wing and biasing the first actuation wing to the first position and the second actuation wing to the third position.

* * * * *